US011624541B2

(12) United States Patent
Fischer et al.

(10) Patent No.: US 11,624,541 B2
(45) Date of Patent: Apr. 11, 2023

(54) IN DOOR ICE BIN FOR AN AUTOMATIC ICE MAKER

(71) Applicant: WHIRLPOOL CORPORATION, Benton Harbor, MI (US)

(72) Inventors: Marcus Fischer, Stevensville, MI (US); Christopher R. McElvain, Amana, IA (US); Ryan D. Schuchart, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 126 days.

(21) Appl. No.: 17/168,500

(22) Filed: Feb. 5, 2021

(65) Prior Publication Data

US 2021/0164717 A1 Jun. 3, 2021

Related U.S. Application Data

(63) Continuation of application No. 16/275,925, filed on Feb. 14, 2019, now Pat. No. 10,914,501, which is a continuation of application No. 14/984,760, filed on Dec. 30, 2015, now Pat. No. 10,228,179, which is a continuation-in-part of application No. 14/921,236, filed on Oct. 23, 2015, now Pat. No. 9,915,458.

(60) Provisional application No. 62/067,725, filed on Oct. 23, 2014.

(51) Int. Cl.

| | |
|---|---|
| ***F25C 5/20*** | (2018.01) |
| ***F25C 5/185*** | (2018.01) |
| ***F25D 23/04*** | (2006.01) |

(52) U.S. Cl.

CPC ..... *F25C 5/22* (2018.01); *F25C 5/185* (2013.01); *F25D 23/04* (2013.01); *F25C 2500/08* (2013.01)

(58) Field of Classification Search

CPC ..... F25C 2500/08; F25C 5/22; F25C 5/185; F25D 23/04

See application file for complete search history.

(56) References Cited

U.S. PATENT DOCUMENTS

| | | | |
|---|---|---|---|
| 3,648,964 | A | 3/1972 | Fox |
| 4,676,405 | A | 6/1987 | Lents et al. |
| 6,425,259 | B2 | 7/2002 | Nelson et al. |
| 6,488,463 | B1 | 12/2002 | Harris |
| 7,469,553 | B2 | 12/2008 | Wu et al. |

(Continued)

FOREIGN PATENT DOCUMENTS

| | | | |
|---|---|---|---|
| EP | 2375200 | A1 | 10/2011 |
| EP | 2660541 | A2 | 11/2013 |

(Continued)

*Primary Examiner* — Ana M Vazquez

(74) *Attorney, Agent, or Firm* — Price Heneveld LLP

(57) ABSTRACT

An ice maker assembly includes an ice maker that has a mounting plate that includes an engagement feature with an engagement surface. An ice storage bin is configured for insertion into an ice maker receiving space of the ice maker. The ice storage bin includes a retention surface configured to engage with the mounting plate when the ice storage bin is inserted into the ice maker receiving space and an ice bin base that defines a track system configured to move the ice storage bin both vertically and horizontally. The track system includes an elongate portion configured to move the ice storage bin horizontally and a widened portion configured to facilitate vertical movement of the ice storage bin.

19 Claims, 22 Drawing Sheets

(56) References Cited

U.S. PATENT DOCUMENTS

| | | | | |
|---|---|---|---|---|
| 7,744,173 | B2 | 6/2010 | Maglinger et al. | |
| 7,832,227 | B2 | 11/2010 | Wu et al. | |
| 7,963,120 | B2 | 6/2011 | An et al. | |
| 8,104,304 | B2 | 1/2012 | Kang et al. | |
| 8,302,423 | B2 * | 11/2012 | Lee | F25C 1/04 62/340 |
| 8,683,822 | B2 | 4/2014 | Kang et al. | |
| 8,733,113 | B2 | 5/2014 | An et al. | |
| 8,864,252 | B1 * | 10/2014 | Rodriguez Cobas | F25D 23/04 312/405.1 |
| 8,893,523 | B2 | 11/2014 | Talegaonkar et al. | |
| 9,261,303 | B2 | 2/2016 | Jeong et al. | |
| 2008/0289355 | A1 | 11/2008 | Kang et al. | |
| 2009/0038330 | A1 | 2/2009 | Lee et al. | |
| 2009/0205358 | A1 * | 8/2009 | Smtih | F25C 5/182 312/401 |
| 2010/0126203 | A1 | 5/2010 | Kim et al. | |

FOREIGN PATENT DOCUMENTS

| | | | |
|---|---|---|---|
| EP | 2743606 | A2 | 6/2014 |
| RU | 2006117063 | A | 1/2008 |
| WO | 2012023717 | A2 | 2/2012 |
| WO | 2012025369 | A3 | 3/2012 |

* cited by examiner

IN DOOR ICE BIN FOR AN AUTOMATIC ICE MAKER

CROSS-REFERENCE TO RELATED APPLICATIONS

This application is a continuation of U.S. patent application Ser. No. 16/275,925, now U.S. Pat. No. 10,914,501, filed Feb. 14, 2019, entitled "IN DOOR ICE BIN FOR AN AUTOMATIC ICE MAKER," which is a continuation of U.S. patent application Ser. No. 14/984,760, now U.S. Pat. No. 10,228,179, filed Dec. 30, 2015, entitled "IN DOOR ICE BIN FOR AN AUTOMATIC ICE MAKER," which is a continuation-in-part of U.S. patent application Ser. No. 14/921,236, now U.S. Pat. No. 9,915,458, filed on Oct. 23, 2015, entitled "METHOD AND APPARATUS FOR INCREASING RATE OF ICE PRODUCTION IN AN AUTOMATIC ICE MAKER," which claims priority to and the benefit under 35 U.S.C. § 119(e) of U.S. Provisional Patent Application No. 62/067,725, filed on Oct. 23, 2014, entitled "METHOD AND APPARATUS FOR INCREASING RATE OF ICE PRODUCTION IN AN AUTOMATIC ICE MAKER," the entire disclosures of which are hereby incorporated herein by reference.

BACKGROUND OF THE DISCLOSURE

In the typical automatic ice maker within a refrigerator, a heater is used to heat the ice tray after the water is frozen, to allow the ice to release from the ice tray. After the ice is frozen, the heater may melt a layer of ice back into water. The ice tray is then rotated and the layer of water between the ice and the ice tray allows the ice to slip out of the ice tray and into an ice bin. Typically, this type of ice maker is called a "Fixed Mold" ice maker because a shaft running the length of the ice maker, down the center axis, rotates and fingers coming out of it flip the cubes out of the mold and into the bin.

Stand-alone ice trays may harvest the ice without the use of a heater by twisting the ice tray breaking the bonds of the ice cubes to the tray. Stand-alone ice trays that are manually filled with water may be set in a freezer to freeze into ice, and then removed for harvesting. The ice from a stand-alone tray may be harvested either individually or into an ice bucket. Removal of the bucket from the appliance may result in loss or spillage of ice due to rotation of the bucket.

SUMMARY

According to one aspect of the present disclosure, an ice maker assembly includes an ice maker that has a mounting plate that includes an engagement feature with an engagement surface. An ice storage bin is configured for insertion into an ice maker receiving space of the ice maker. The ice storage bin includes a retention surface configured to engage with the mounting plate when the ice storage bin is inserted into the ice maker receiving space and an ice bin base that defines a track system configured to move the ice storage bin both vertically and horizontally. The track system includes an elongate portion configured to move the ice storage bin horizontally and a widened portion configured to facilitate vertical movement of the ice storage bin.

According to another aspect of the present disclosure, a refrigerator includes a cabinet that includes an automatic ice maker assembly that has a mounting plate with an angled ramp and an engagement member. The automatic ice maker assembly also has an ice storage bin that includes an ice bin wall positioned on an ice bin base, a sloped surface configured to engage the angled ramp, and a retention member configured to engage with the engagement member. An ice maker receiving space is defined within the cabinet and includes a rail system disposed on opposite sides of the ice maker receiving space. A track system is defined in the ice bin base and is configured to engage the rail system such that the ice storage bin moves along the rail system. The track system includes a widened portion configured to facilitate vertical movement of the ice storage bin.

According to yet another aspect of the present disclosure, ice maker assembly includes an ice maker and a mounting plate positioned within an ice maker receiving space. The mounting plate defines a plurality of engagement features that extend into the ice maker receiving space. An ice storage bin is removably positioned within the ice maker receiving space. The ice storage bin includes an ice bin base, an auger assembly disposed through the ice bin base, an auger motor shaft disposed through the mounting plate, an ice tray that has a first end and a second end, and a motor that rotates the first end and the second end about an axis of rotation. The motor rotates the first end further than the second end.

These and other aspects, objects, and features of the present disclosure will be understood and appreciated by those skilled in the art upon studying the following specification, claims, and appended drawings.

DETAILED DESCRIPTION

Figure 1:
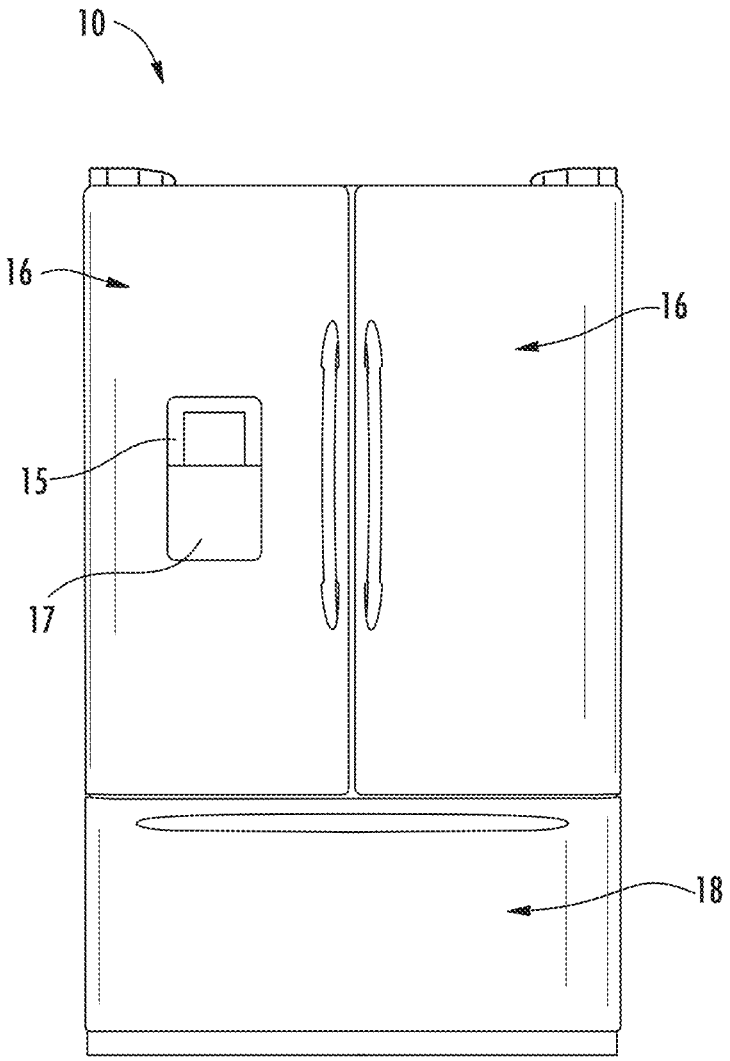
FIG. 1 is an elevated front view of a French-Door Bottom Mount type refrigerator.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference numeral 10 generally designates a refrigerator with an automatic ice maker 20. As described below, an automatic ice maker 20 is an ice maker either as a stand-alone appliance, or within another appliance, such as a refrigerator, wherein the ice making process is typically induced, carried out, stopped, and the ice is harvested with substantially no user input.

FIG. 1 generally shows a refrigerator 10 of the French-Door Bottom Mount type, but it is understood that this disclosure could apply to any type of refrigerator, such as a side-by-side, two-door bottom mount, or a top-mount type. As shown in FIGS. 1-2B, the refrigerator 10 may have a fresh food compartment 12 configured to refrigerate and not freeze consumables within the fresh food compartment 12, and a freezer compartment 14 configured to freeze consumables within the freezer compartment 14 during normal use. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16.

Figure 2A:
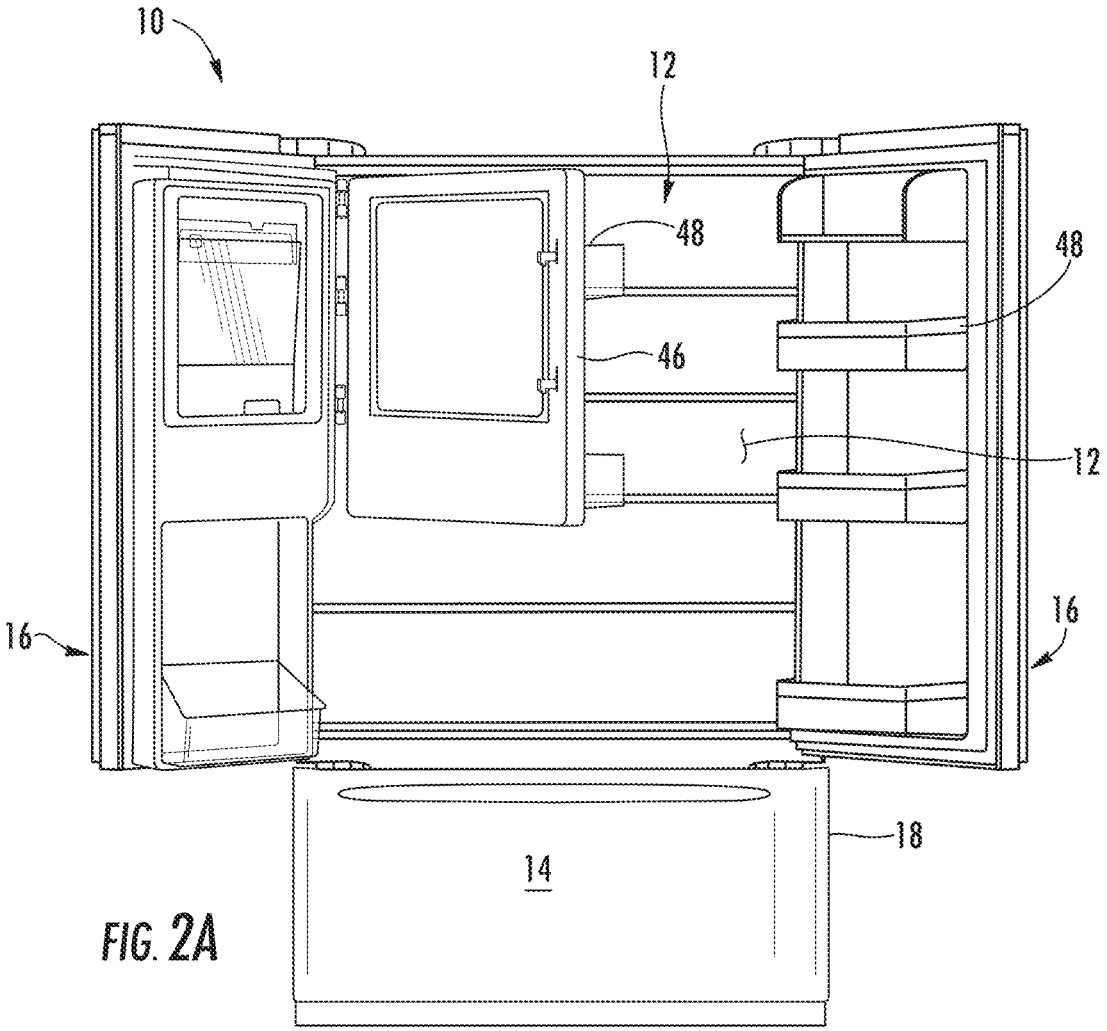
FIG. 2A is an elevated front view of a French-Door Bottom Mount type refrigerator with the refrigerator compartment doors open.
Figure 2B:
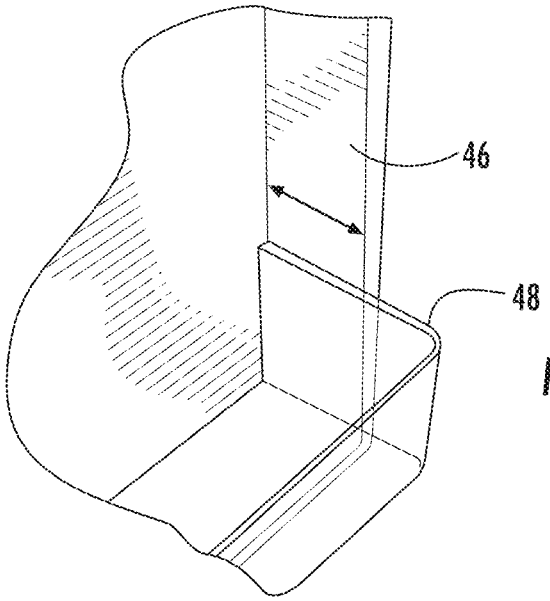
FIG. 2B is a perspective view of an aspect of an access door for the ice maker.
Figure 3:
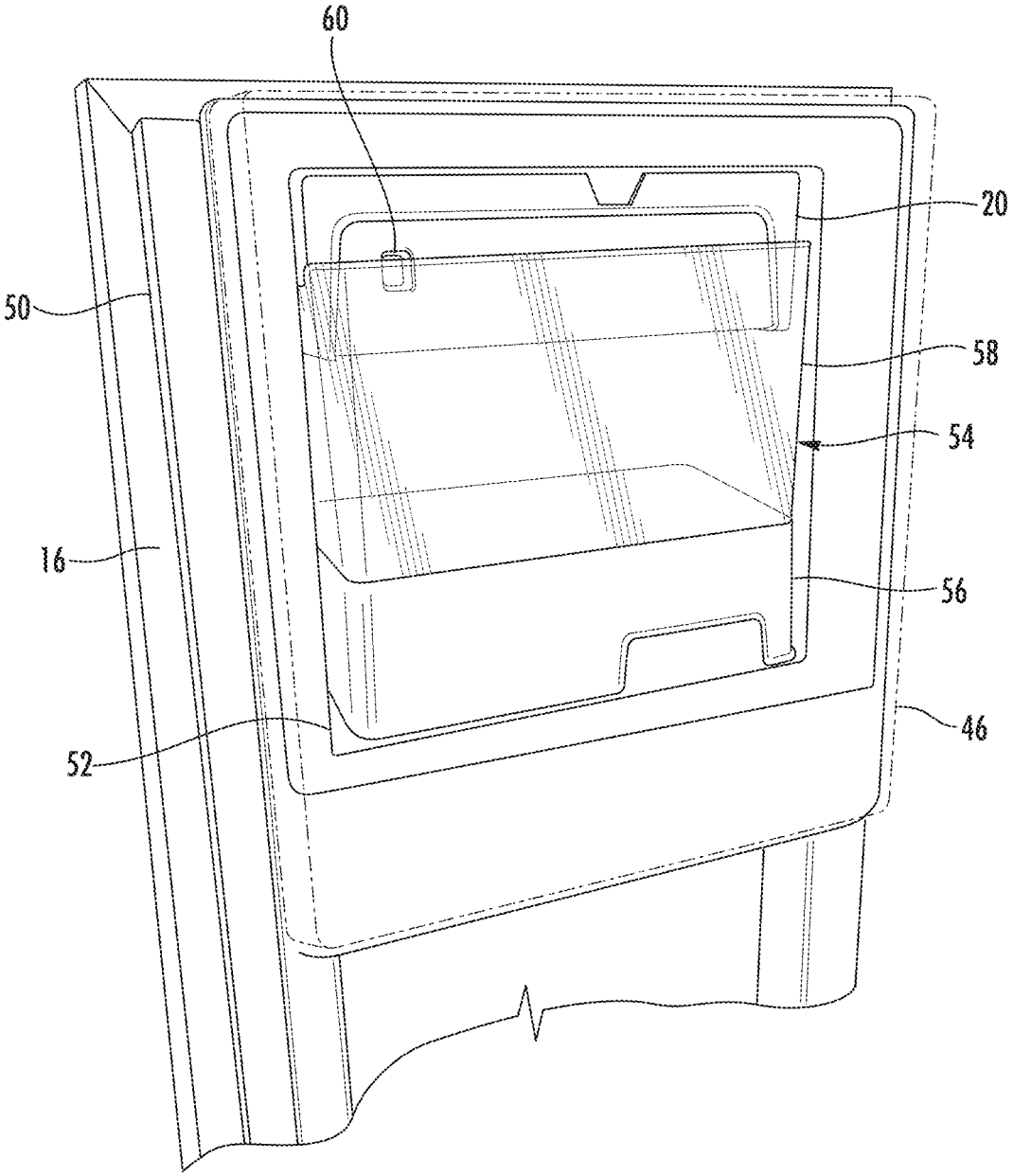
FIG. 3 is a perspective view of the interior of one door of the refrigerator compartment with the ice maker and ice bin installed.

Referring now to FIGS. 1-4B, it is generally known that the freezer compartment 14 is typically kept at a temperature below the freezing point of water, and the fresh food compartment 12 is typically kept at a temperature above the freezing point of water and generally below a temperature of from about 35° F. (1.67° C.) to about 50° F. (10° C.), more typically below about 38° F. (3.33° C.). As shown in FIGS. 2A-3, an ice maker 20 may be located on a door 16 to the refrigerated fresh food compartment 12. As described below, the ice maker 20 is defined as an assembly of a bracket 22, a motor 24, an ice tray 28, a bail arm 98 connected to the motor 24, at least one wire harness and at least one thermistor. The door 16 may include the ice maker 20 and ice bin access door 46 hingedly connected to one of the doors 16 for the refrigerator 10 along the side proximate the hinge for the door 16 of the refrigerator 10 carrying the ice maker 20, i.e. the vertical edge closest to the cabinet. The hinge may be a single or multiple hinge(s) and may be spaced along the entire edge, substantially the entire edge, or more frequently two hinges may be used with one close to the top edge of the access door 46 and one close to the bottom edge of the access door 46.

Significantly, due at least in part to the access door 46 and the design and size of the ice maker 20, the access door 46 has a peripheral edge liner that extends outward from the surface of the access door 46 and defines a dike wall. The dike walls extend from at least the two vertical sides, but more typically all four sides, and define a door bin receiving volume along the surface of the access door 46. The access door 46 is selectively operable between an open position, in which the ice maker 20 and an ice storage bin 54 are accessible, and a closed position, in which the ice maker 20 and the ice storage bin 54 are not accessible. The access door 46 may also include door bins 48 that are able to hold smaller food items. The door bins 48 may also be located on or removably mounted to the access door 46 and at least partially spaced within the door bin 48 receiving volume of the access door 46. While not typically the case, the ice maker 20 may also be located exterior the fresh food compartment 12, such as on top of the refrigerator cabinet, in a mullion between the fresh food compartment 12 and the freezer compartment 14, in a mullion between two fresh food compartments 12, or anywhere else an automatic, motor driven ice maker 20 may be located.

The refrigerator 10 may also have a duct or duct system with an inlet in the freezer compartment 14 and an outlet in the fresh food compartment 12. The duct may be situated such that the length of the duct necessary to direct air from the freezer compartment 14 to the fresh food compartment 12 is minimized, reducing the amount of heat gained in the travel between the inlet and the outlet. The duct outlet located in the fresh food compartment 12 may be positioned at a location near the ice maker 20. The refrigerator 10 may also have one or more fans, but typically has a single fan located in the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20, to freeze into ice cubes. In the embodiment shown, the ice maker 20 is located in the fresh food compartment 12, which typically holds air above the freezing point of water.

In various embodiments, where the ice maker 20 is located in a compartment or location other than in the freezer compartment 14, a fan is needed to force the air to the ice maker 20. In other embodiments, the fan or fans may be located either in the freezer compartment 14, the fresh food compartment 12, or in another location where the fan is able to force air through the duct. The ice maker 20 is often positioned within a door 16 of the refrigerator 10 to allow for delivery of ice through the door 16 in a dispensing area 17 on the exterior of the refrigerator 10, typically at a location on the exterior below the level of the ice storage bin 54 to allow gravity to force the ice down an ice dispensing chute 44 into the refrigerator door 16. The chute 44 extends from the bin 54 to the dispensing area 17 and ice is typically pushed into the chute 44 using an electrical power driven auger. Ice is dispensed from the ice storage bin 54 to the user of the refrigerator 10.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area 17 and another to an ice tray. The refrigerator 10 may also have a control board or controller that sends electrical signals to the one or more valves when prompted by a user that water is desired or if an ice making cycle is required.

FIGS. 2A-5B show enlarged views of the ice making assembly according to one aspect of the present disclosure and demonstrates one feature of the present disclosure, namely, the significantly smaller overall size of the ice making assemblies of the present disclosure over the prior heaterless ice making assemblies.

FIG. 3 shows a closer view of a door 16 with the access door 46 in hidden lines to show the ice maker 20. The door 16 may have an inner liner 50 which defines an ice maker receiving space 52 in which the ice maker 20 and an ice storage bin 54 of an ice maker assembly 400 are disposed. The ice maker receiving space 52 is typically about 750-800 cubic inches and preferably about 763 cubic inches (12,512 cubic cm). The ice maker receiving space 52 is typically less than 11 inches×12 inches×7 inches or may be about 10.5 inches×11 inches×6.5 inches or about 267 mm×279 mm×165 mm. The ice maker 20 may be located at an upper portion of the ice maker receiving space 52. The ice bin 54 may be located below the ice maker 20 such that as ice is harvested, the ice maker 20 uses gravity to transfer the ice from the ice maker 20 to the ice storage bin 54. The ice storage bin 54 may include an ice bin base 56 and one or more ice bin walls 58 that extends upwardly from the perimeter of the ice bin base 56. The ice maker 20 may include an on/off switch 60. The on/off switch 60 may be located on the ice maker 20 in a location that is accessible to a user without removing the ice maker 20 from the door 16 or the refrigerator 10. The ice bin wall 58 may be configured such that when the ice storage bin 54 is placed in the door 16, the on/off switch 60 is inaccessible to the user, and when the ice storage bin 54 is removed from the door 16, the on/off switch 60 is accessible to a user. The ice storage bin wall 58 may be made of a clear plastic material such as a copolyester so that a user can see the on/off switch 60 even while inaccessible when the ice bin 54 is in place. However, the front portion of the ice bin wall 58 typically extends to cover the on/off switch 60 when in the installed position to prevent inadvertent actuation of the on/off switch 60. The front portion of the ice bin wall 58 also typically extends upward to form a lip that extends around at least a portion of the ice maker 20 to further retain ice.

Figure 4A:
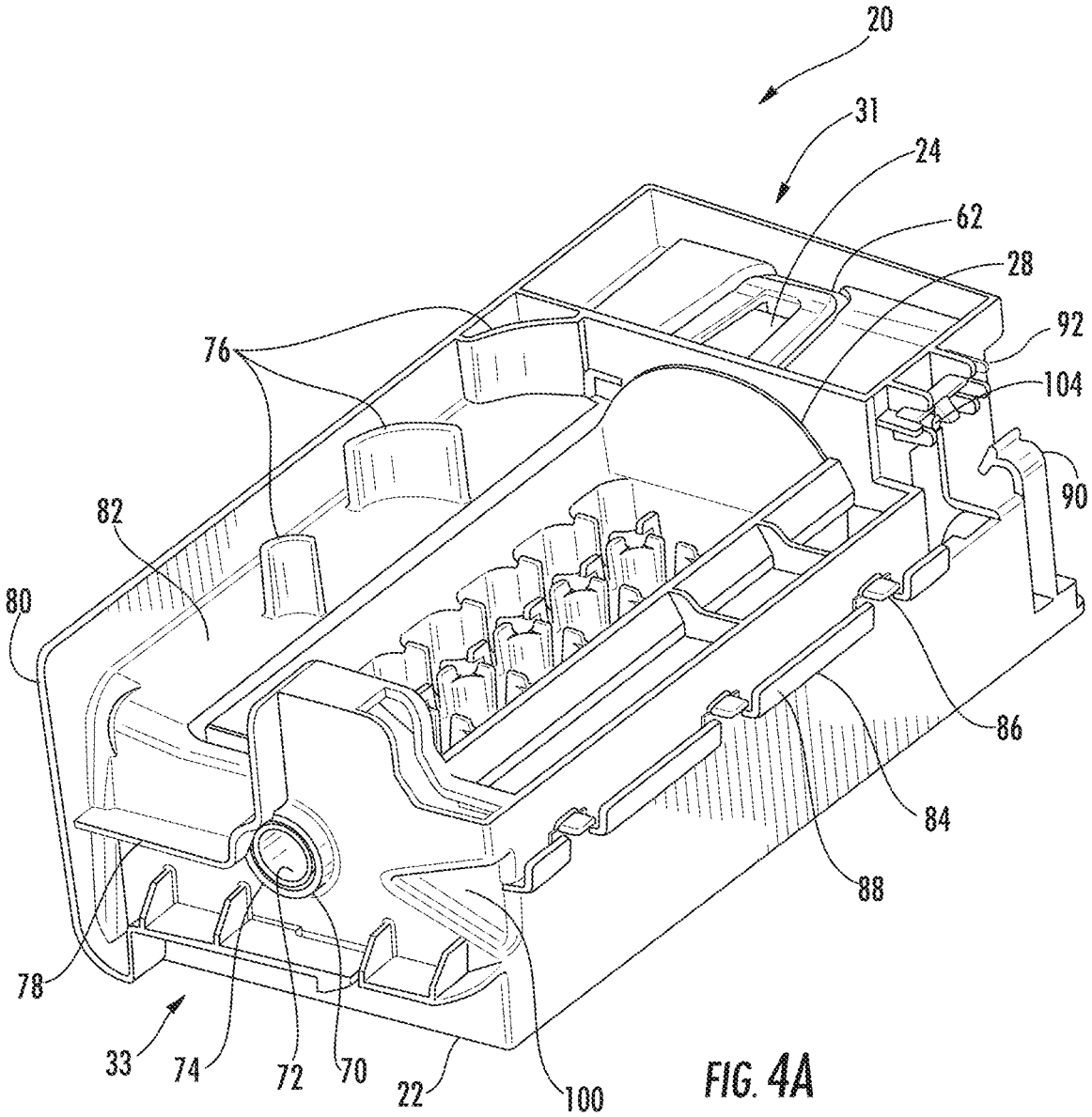
FIG. 4A is an isometric view of the top of an ice maker according to an aspect of the present disclosure.

FIGS. 4A (top perspective view) and 4B (top perspective view from the opposing side) show isometric views of the ice maker 20. The ice maker 20 may include the bracket 22, a motor 24, and an ice tray 28. The bracket 22 is used to locate the motor 24 and the ice tray 28. The motor 24 may be disposed on one end 31 of the bracket 22. The motor 24 may be held in place on the bracket 22 by motor locking tabs 62 and 94, which allow the motor 24 to be placed in the bracket 22, but will not release the motor 24 until the motor locking tabs 62 and 94 are actuated by a user, typically by hand and without the use of tools. In another embodiment, the motor 24 may be disposed on the door 16 of the fresh food compartment 12. As shown in FIG. 4A, the bracket 22 and ice tray 28 are configured to fit together in such a way that the combination is free of apertures between the motor 24 and the ice wells 38 (exemplified in FIGS. 5A and 5B) in order to keep water out of the area where the motor 24 is installed.

As shown in FIGS. 4A-8, the ice tray 28 has a first end 30 and a second end 32. The first end 30 is configured to engage the motor 24 through a motor interface 64. The motor interface 64 may include a rib structure 68, which produces added strength and structure to the interface, and an aperture 66. The motor interface 64 is located at the first end 30 of the ice tray 28. The aperture 66 as shown may be a dog-bone shape aperture, although other shapes are contemplated. This unique structural shape allows for superior transfer of torque from the motor 24 to the ice tray 28 and also avoids plastic deformation or any other undesirable effect or permanent damage from repeated twisting action of the ice tray 28 of the present disclosure. The ice tray 28 is typically made of a polypropylene-polyethylene copolymer that allows for easy release of the ice and good durability of the ice tray 28 in a freezing environment, but may also contain minor amounts of other materials and polymers that would not affect the release and durability characteristics of the ice tray 28.

The ice tray 28 typically has a second end 32 with a bracket interface 70. The bracket interface 70 may be generally circular in shape and correspond to a circular tray interface 74 on the bracket 22. The outside diameter of the bracket interface 70 on the ice tray 28 is typically slightly smaller than the inside diameter of the tray interface 74 on the bracket 22 and is configured to fit within the tray interface 74. This fit allows for rotational movement of the ice tray 28 with respect to the bracket 22 without allowing for excessive lateral movement of the bracket interface 70 within the tray interface 74.

The bracket 22 further includes a front flange 80 and an air inlet flange 78 defining an ice maker supply duct 82 that supplies air from the outlet in the fresh food compartment 12 to the ice tray 28. The bracket 22 further includes a plurality of air deflectors 76, or vanes, generally disposed within the ice maker cold air supply duct 82. The air deflectors 76 typically extend upward from the bracket 22 along the cold air supply duct 82 of the bracket 22 of the ice maker 20. From two to five air deflectors 76 are typically used and most typically three air deflectors 76 are used. The plurality of air deflectors 76 may direct the air in the ice maker supply duct 82 uniformly over the ice tray 28. In the embodiment shown, there are three air deflectors 76, or vanes. Depending upon the particular design of the ice maker 20, fewer air deflectors 76 may not generally uniformly direct the air over the ice tray 28, and more deflectors 76 may use more power to push the air through the cold air supply duct 82 of the ice maker 20. The air deflectors 76 can vary in size. By way of example, and not limitation, the air deflectors 76 may be larger in size the further they are positioned from the cold air source. The air deflectors 76 typically increase in arcuate distance to catch and redirect more cold air as the air passes by each successive air deflector 76. In the exemplified aspect of the device, three air deflectors 76 are configured as shown in FIG. 4A. The air deflectors 76 are included to provide even cooling across the ice tray 28.

The air inlet flange 78 may be located at a location generally corresponding to the outlet of the duct in the fresh food compartment 12. The air inlet flange 78 and the front flange 80 constrain air exiting the duct outlet in the fresh food compartment 12 and prevent the air from reaching the fresh food compartment 12. The bracket 22 typically further includes a plurality of wire harness supports 84 and tabs 86 for containing or otherwise stowing electrical wiring for the ice maker 20 from view. These wire harness supports 84 and tabs 86 may be disposed on the back of the bracket 22 in an alternating pattern. This alternating pattern of supports 84 and tabs 86 allows an ice maker wire harness to be held in place in the back of the ice maker 20 and out of sight of a user. The wire harness, upon installation, may rest on the top of the supports 84. The supports 84 may further include an upstanding flange 88 to hold the wire harness in place and prevent the wire harness from removal off of the support 84. The wire harness may be disposed below the tabs 86. The tabs 86 are located between the supports 84 and at a height above the supports 84 not greater than the diameter of the wire harness, which forces the wire harness into a serpentine-like shape along the back side of the ice maker 20 and frictionally retains the ice maker 20, preventing the wire harness from undesirable side-to-side movement. The bracket 22 may further include a wire harness clip 90 which biases and frictionally holds the wire harness in place at the point of entry into the ice maker 20 when installed. While an alternating configuration of supports 84 and tabs 86 are exemplified, other non-alternating or semi-alternating patterns are contemplated.

The ice maker 20 may include a first thermistor 106 (exemplified in FIG. 6B) that can be disposed in the ice tray 28, as well as a second thermistor 104 that can be disposed at least proximate the ice maker receiving space 52 (FIG. 3). The first thermistor 106 may be disposed below and in thermal communication with the ice tray 28, and the second thermistor 104 may be disposed on the bracket 22 adjacent the motor 24. Each thermistor 104, 106 may be connected to the wire harness. The wire for the first thermistor 106 may extend from the wire harness at the end of the ice maker 20 distal the motor 24. The first thermistor wire may also be separate from the wire harness and be routed through a thermistor aperture 72 in the bracket interface 70 of the ice tray 28. The wire may be routed under the ice tray 28 and along its axis of movement as shown by line X-X in FIG. 8. The first thermistor 106 may be disposed on the bottom of the ice tray 28 and be held in place by a thermistor bracket 108 (exemplified in FIG. 6B). The thermistor bracket 108 may include insulation that is configured to ensure the first thermistor 106 is reading substantially only the temperature of the ice tray 28, and not the fresh food compartment 12 or other areas outside of the ice maker receiving space 52.

The second thermistor 104 is typically located or proximate the flow of air from the freezer compartment 14, out of the refrigerator compartment outlet, and over the ice tray 28. The second thermistor 104 may be placed on the bracket 22 downstream of the ice tray 28. In one embodiment as shown in FIG. 4A, the second thermistor 104 or ice compartment thermistor is disposed adjacent the motor 24 on the bracket 22, and held in place by an ice compartment thermistor mounting bracket 92. The ice compartment thermistor mounting bracket 92 may include one or more clips and flanges configured such that the mounting bracket 92 allows the second thermistor 104 to be installed and removed without the use of tools. The mounting bracket 92 typically frictionally retains the second thermistor 104. The thermistor mounting bracket 92 also may be configured to prevent the second thermistor 104 from moving laterally in any direction.

Figure 5A:
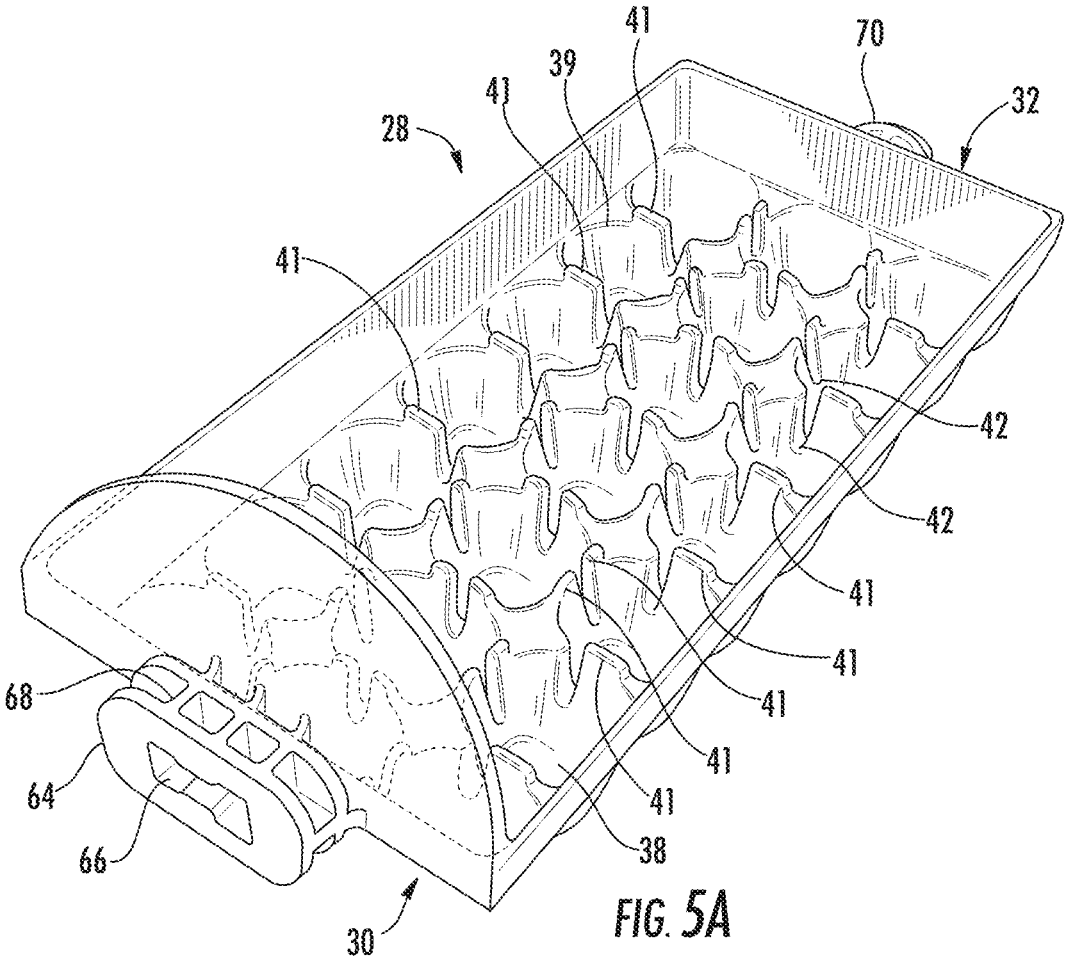
FIG. 5A is an isometric perspective view of an ice tray according to an aspect of the present disclosure.
Figure 5B:
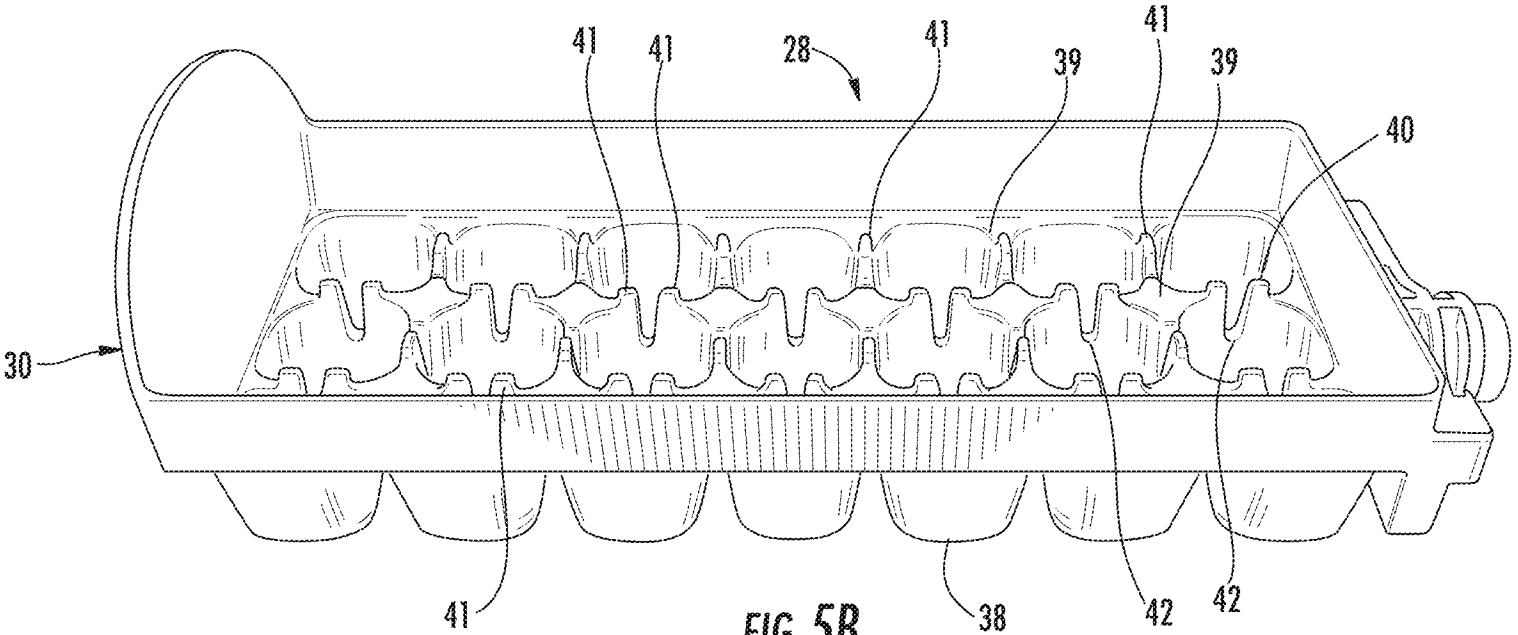
FIG. 5B is a perspective view of an ice tray according to an aspect of the present disclosure.

Turning to FIGS. 5A and 5B, the ice tray 28 may have a number of ice wells 38. The ice wells 38 may be lined up in rows configured parallel with an axis of twist X-X (exemplified in FIG. 8), and columns configured normal to the axis of twist X-X. The ice tray 28 may have weirs 40 between the ice wells 38. The weirs 40 may have water channels or passages 42 that allow water to flow through the weirs 40 between the ice wells 38 when the ice tray 28 is being filled. The ice tray 28 of the present disclosure typically further has an ice tray top surface 39. The weirs 40 typically have an upwardly extending projecting portion 41 that extends or projects above the top surface 39. This allows for generally even water flow through the passages 42 during a fill cycle when the ice wells 38 or cavities are filled with water before freezing.

Figure 6A:
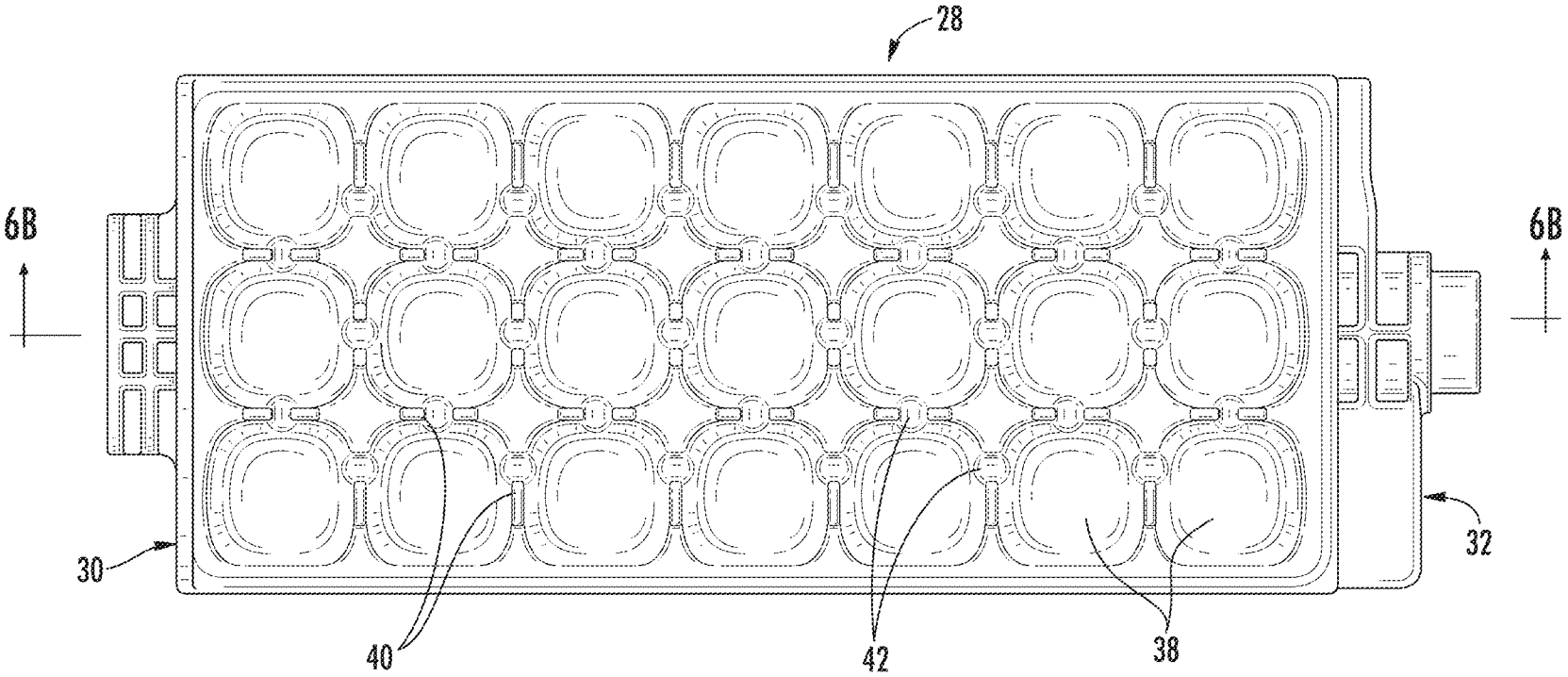
FIG. 6A is a top plan view of an ice tray according to an aspect of the present disclosure.
Figure 6B:
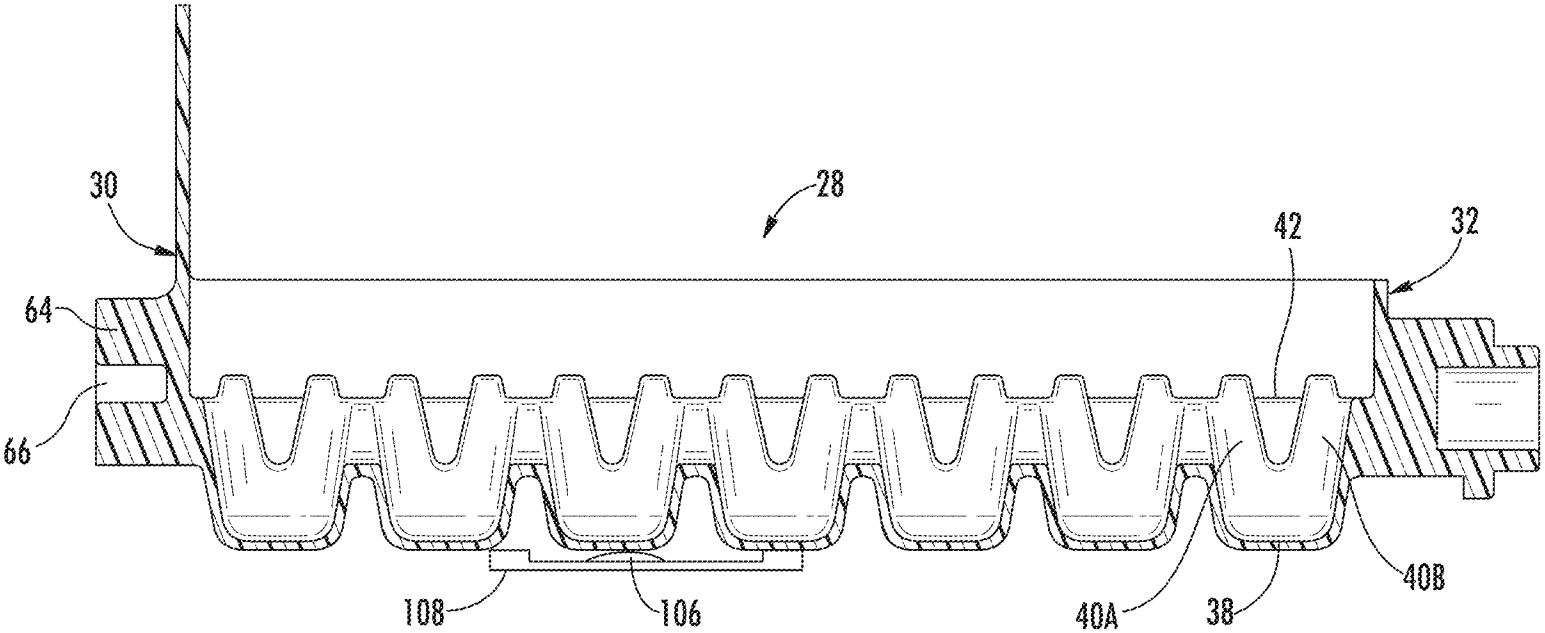
FIG. 6B is a cross-section through an ice tray taken along line 6B-6B in FIG. 6A according to an aspect of the present disclosure.
Figure 7:
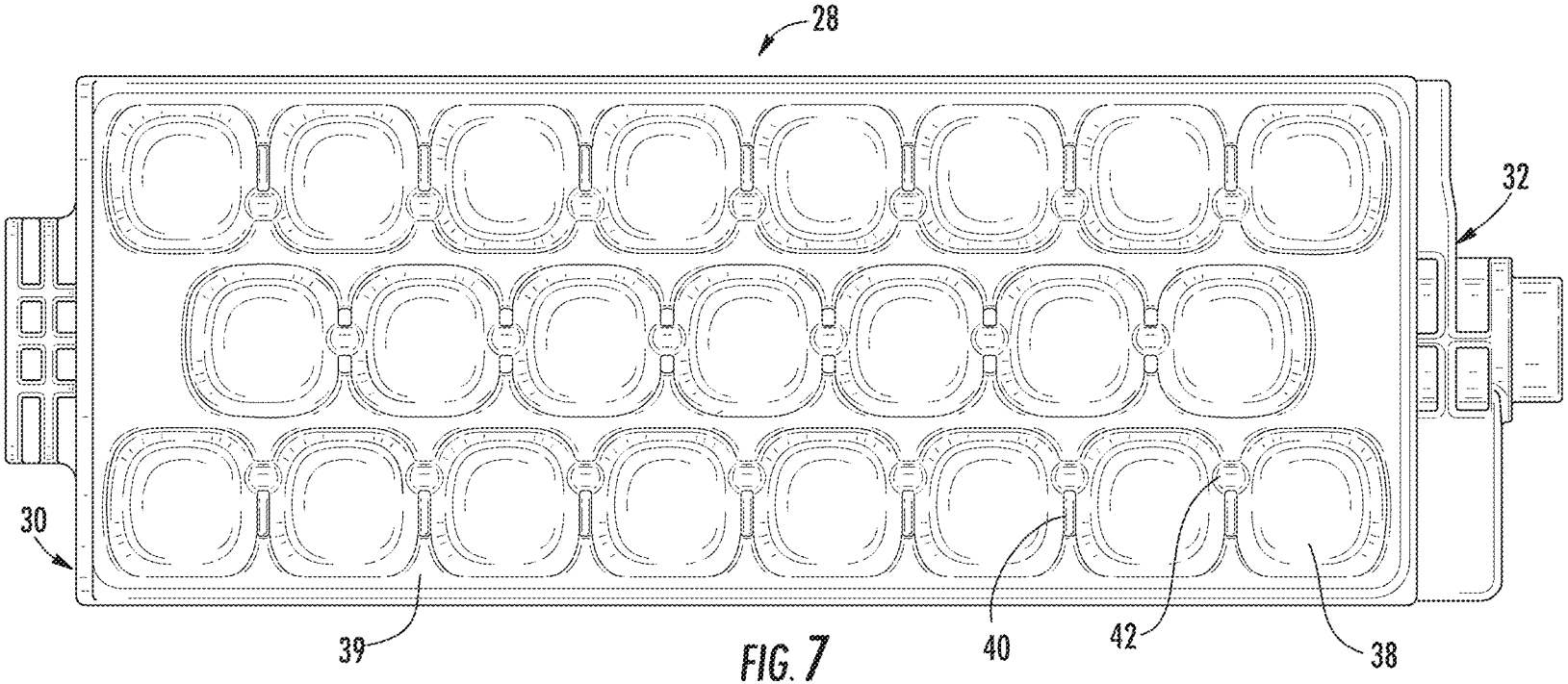
FIG. 7 is a top perspective view of an ice tray according to an aspect of the present disclosure.

FIGS. 6A and 6B show the weirs 40 and the water channels or passages 42 in more detail. FIG. 6B shows a section through one row of ice wells 38, as shown by the section in FIG. 6A. Each ice well 38 may be separated by a weir 40. The weirs 40 define the shape and size of the ice well 38. The weir 40 may have a passage 42 that allows fluid to flow more freely between the ice wells 38. The passage 42 separates the weir 40 into two parts, shown in FIGS. 6B as 40A and 40B. Although the water channels or passages 42 may be substantially uniform along the row of ice wells 38, the area of the passage 42 may be larger in an ice well 38 in a position closer to the first end 30 and a second end 32 (as exemplified in FIG. 6B) than the area of a passage 42 in an ice well 38 that is closer to the middle of a row of ice wells 38 between the ends. In another embodiment, the ice wells 38 may be staggered as shown in FIG. 7.

Referring to FIGS. 4A-6B, to assemble the ice maker 20, an operator may attach the bail arm 98 with a fastener such as a screw. The operator may then place the ice tray 28 into the bracket 22 by the first end 30, and the rotate the second end 32 into the bracket tray interface 74. The motor 24 may then be snapped into place by hand and without the use of tools, engaging the first end 30 of the ice tray 28. A wire harness, including a motor connector, may then be connected to the motor 24. The wire harness is then routed through the wire harness supports 84, tabs 86 and flanges 88 to the end of the bracket 22 distal the motor 24. The first thermistor 106 may then be placed on the underside of the ice tray 28 and a thermistor bracket 108 snapped over the first thermistor 106 by hand without the use of tools, thereby holding the first thermistor 106 in place. The thermistor bracket 108 typically includes a thermally resistant layer in contact with the first thermistor 106. This thermally resistant layer is designed to keep the first thermistor 106 in contact with the ice tray 28 and out of the flow of air over the ice tray 28. Keeping the first thermistor 106 out of the flow of air prevents the thermistor 106 from reading a frozen temperature before the ice is ready for harvesting. A compartment thermistor, such as the second thermistor 104, may then be snapped into place by hand, without the use of tools, into the thermistor mounting bracket 92 on the bracket 22.

Figure 4B:
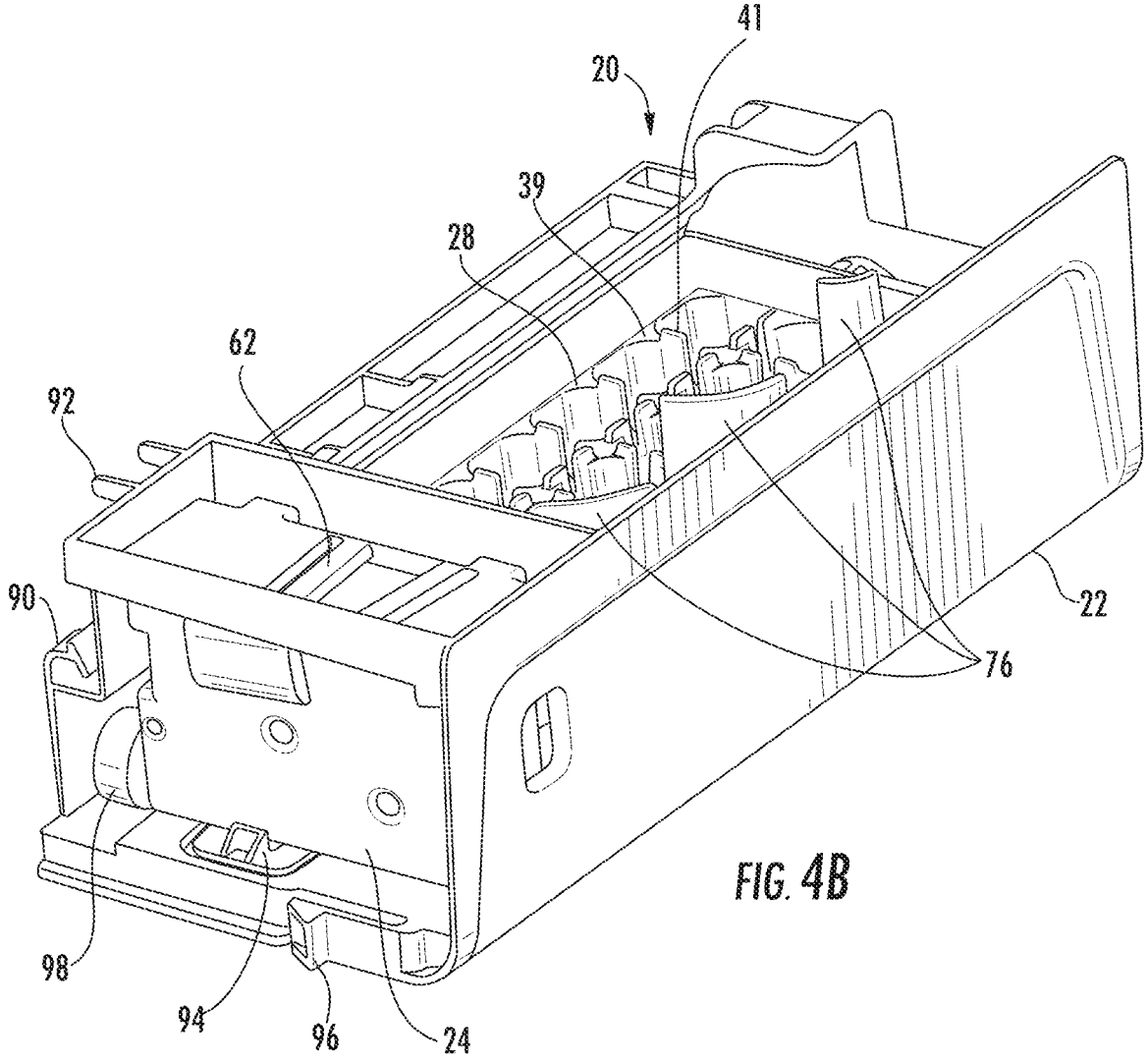
FIG. 4B is another isometric view of the top of an ice maker.

The ice maker 20 may then be snapped into place on the door 16 of the refrigerator 10 by hand and without the use of tools, and the wire harness may then be connected to a refrigerator wire harness. The ice maker 20 may be held in place by an ice maker snap 96 as shown in FIG. 4B. To remove the ice maker 20, a user may simply actuate the ice maker snap 96 to free the ice maker 20 from the door 16, and disconnect the wire harness from the refrigerator wire harness. The ice maker 20 is typically less than 12 inches×4 inches×6 inches (305 mm×102 mm×152 mm) and may be 10.6 inches×3.5 inches×5.25 inches (269.2 mm×88.9 mm×133.4 mm).

In operation, the ice maker 20 may begin an ice making cycle when a controller in electrical communication with the sensor or ice level input measuring system or device detects that a predetermined ice level is not met. In one embodiment, a bail arm 98 attached to a position sensor is driven, operated or otherwise positioned into the ice storage bin 54. If the bail arm 98 is prevented from extending to a predetermined point within the ice storage bin 54, the controller reads this as "full," and the bail arm 98 is returned to its home position. If the bail arm 98 reaches at least the predetermined point, the controller reads this is as "not full." The ice in the ice tray 28 is harvested as described in detail below, and the ice tray 28 is then returned to its home position, and the ice making process as described in detail below may begin. In alternative embodiments, the sensor may also be an optical sensor, or any other type of sensor known in the art to determine whether a threshold amount of ice within a container is met. The sensor may signal to the controller, and the controller may interpret that the signal indicates that the threshold is not met.

FIGS. 9A-10C detail the typical ice making process. When power is restored to the icemaker as shown in step 200, the ice maker 20 checks whether the ice tray 28 is in home position, as shown in step 210, and as typically exemplified in FIGS. 4A and 4B. Step 212 shows what happens if the ice tray 28 is not in its home position, typically the controller sends a signal to the motor 24 to rotate the ice tray 28 back to its home position. Once the ice tray 28 is determined to be in its home position, as shown in step 230, the controller determines whether any previous harvests were completed. If the previous harvest was completed, as shown in step 232, the controller will typically send an electrical signal to open a valve in fluid communication with the ice maker 20. Either after a predetermined amount of valve open time or when the controller senses that a predetermined amount of water has been delivered to the ice tray 28, a signal will be sent by the controller to the valve to close the valve and stop the flow of water. The predetermined amount of water may be based on the size of the ice tray 28 and/or the speed at which a user would like ice to be formed, and may be set at the point of manufacture or based on an input from a user into a user interface 15 (FIG. 1). Depending upon the design of the ice tray 28, the amount of water may be greater than 100 mL, greater than about 110 mL, or may be as high as 150 mL. The valve will open, allowing water to flow out of the water outlet into the ice tray 28. The valve will stay open typically between 7-10 seconds, ideally for about 7 seconds. The water outlet may be positioned above the ice tray 28, such that the water falls with the force of gravity into the ice tray 28. The water outlet may be positioned over the middle of the ice tray 28, or it may be positioned over the ice wells 38 adjacent the first end 30 or the second end 32.

After step 232, or if in step 230, the controller determines that the previous harvest was not completed, the freeze timer typically is started and air at a temperature below the freezing point of water is forced from the freezer compartment 14 to the ice maker 20. The air may be forced by fan or any other method of moving air known in the art. The air is directed from the freezer 14 to the ice maker 20 via a duct, or a series of ducts, as discussed above, that lead from an inlet in the freezer compartment 14, through the insulation of the refrigerator 10, and to an outlet in the fresh food compartment 12 adjacent the ice maker 20. This air, which is typically at a temperature below the freezing point of water, is directed through the ice maker supply duct 82 of the ice maker 20, past the deflectors 76, into at least substantially even distribution over the ice tray 28 to freeze the water within the ice wells 38 into ice pieces 372.

During the freezing process in step 240, the controller typically determines if a door 16 of the refrigerator 10 has been opened, as shown by step 250. If the door 16 is determined to be open at any time, the freeze timer is paused until the door 16 of the refrigerator 10 is closed, as shown by step 252. After some time, substantially all, or all of the water, will be frozen into ice. The controller may detect this by using the first thermistor 106 located on the underside of the ice tray 28 and in thermal contact with the ice tray 28. During the freezing process in step 240, the controller also typically determines if the temperature of the ice tray 28, or the temperature within the ice compartment, is above a certain temperature for a certain amount of time, as shown by step 270. This temperature is typically between about 20° F. (−6.67° C.) to about 30° F. (−1.11° C.), and more typically about 25° F. (−3.88° C.). The typical time above that temperature is typically about 5-15 minutes, and ideally about 10 minutes. If the controller determines that the temperature was above the specified temperature for longer than the specified time, the freeze timer typically resets.

As shown in step 280, when the freeze timer reaches a predetermined time, and when the first thermistor 106 sends an electrical signal to the controller that a predetermined temperature of the ice tray 28 is met, the controller may read this as the water is frozen, and it typically begins the harvesting process, and the process moves forward to step 290. As shown in step 300, the controller first will ensure that an ice storage bin 54 is in place below the ice tray 28 to receive the ice cubes. The ice maker 20 may have a proximity switch that is activated when the ice storage bin 54 is in place. The ice maker 20 may also utilize an optical sensor, or any other sensor known in the art, to detect whether the ice storage bin 54 is in place.

Figure 8:
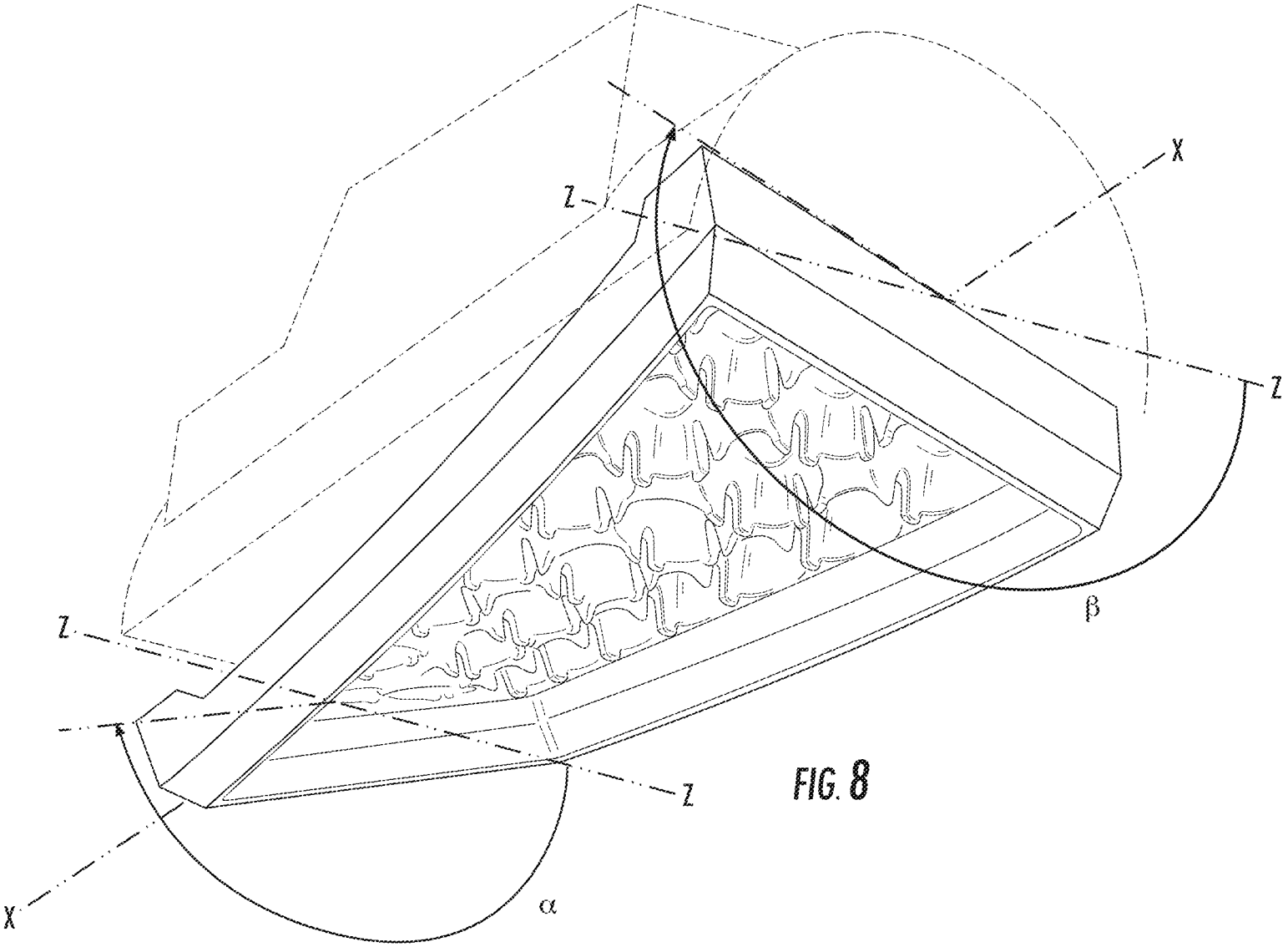
FIG. 8 is an isometric perspective view showing the twist motor of an ice tray according to an aspect of the present disclosure.
Figure 9A:
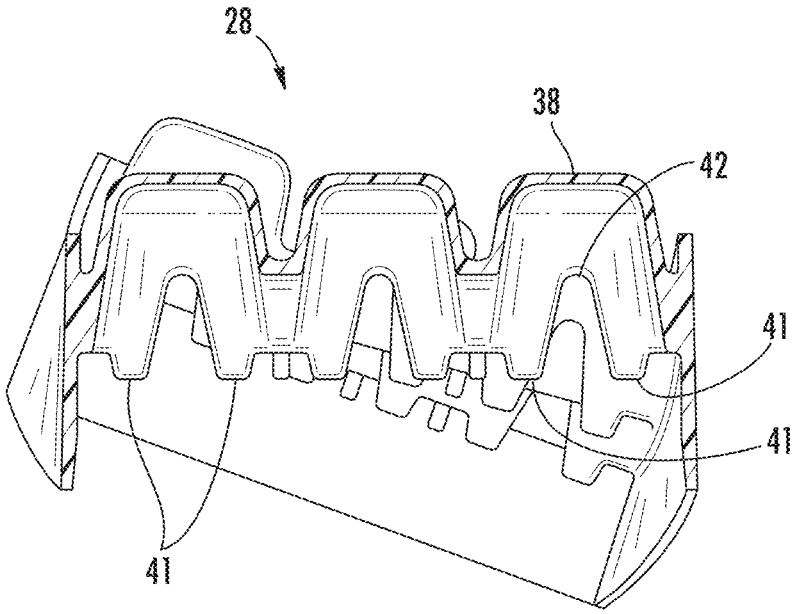
FIG. 9A is a cross-section of an ice tray in a twisted configuration taken along line 9A-9A in FIG. 8.
Figure 9B:
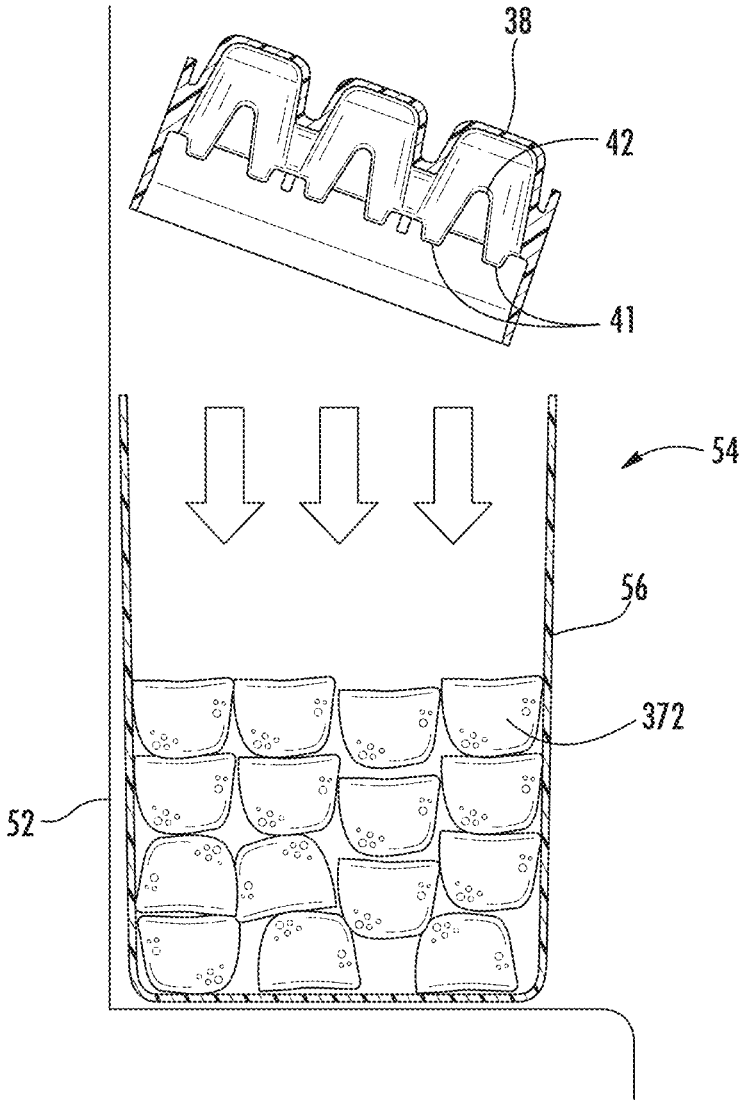
FIG. 9B is a cross-section through an end of an overall ice maker and ice bin portion of a refrigerator showing an ice tray and the ice bin showing the substantially level ice storage within the ice bin due, at least in part, to the methods of dispensing and the ice maker and ice tray, according to an embodiment of the disclosure.
Figure 9C:
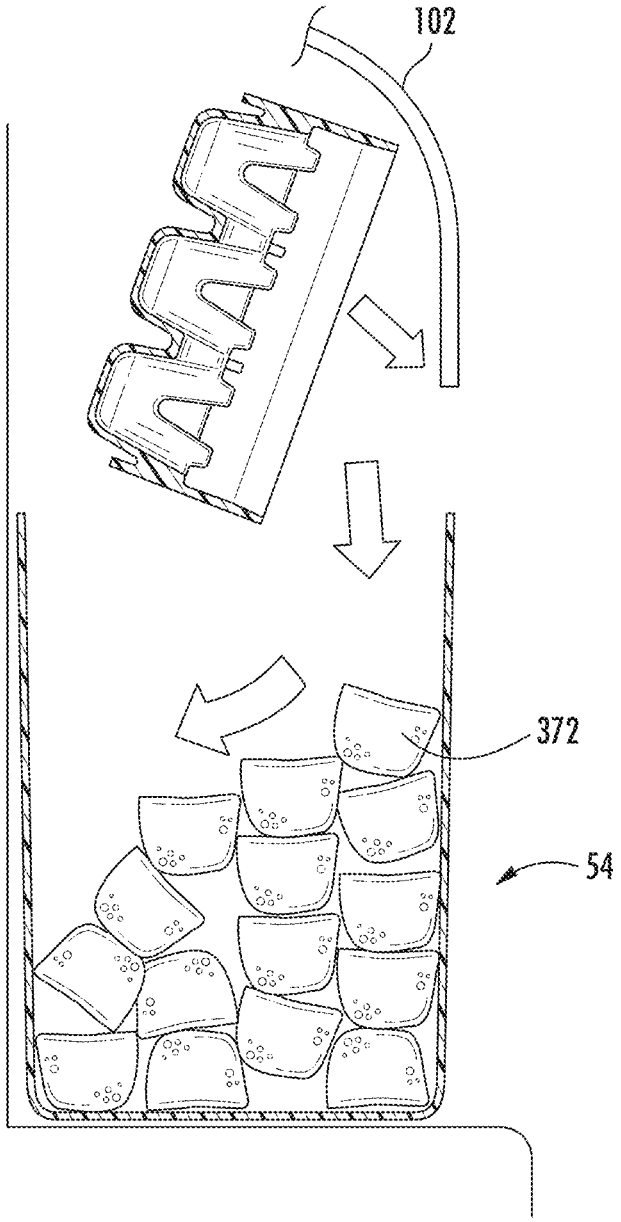
FIG. 9C is a cross-section through a prior-art ice bin showing how it accumulates in an uneven fashion.
Figure 10A:
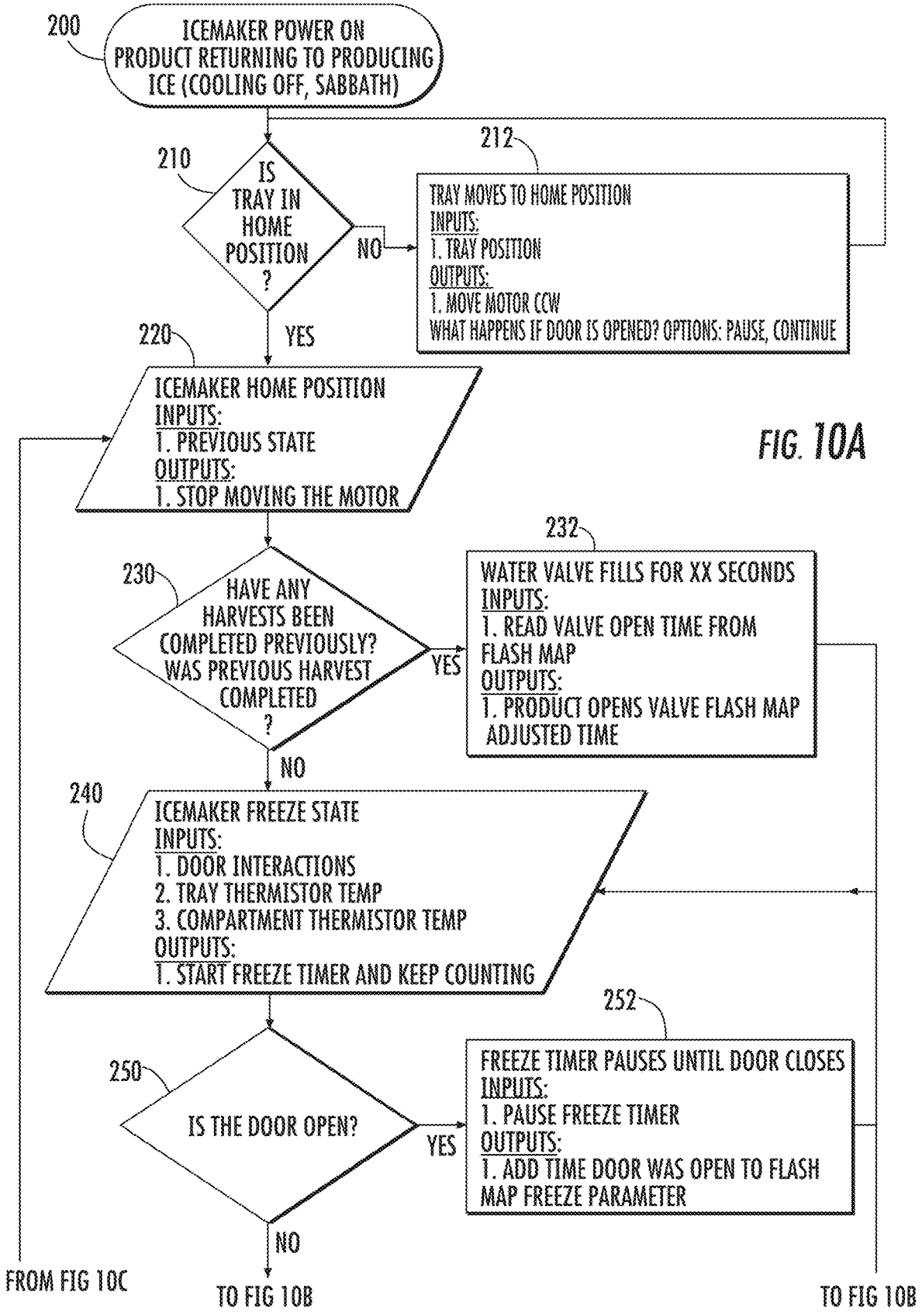
FIGS. 10A-10C are block diagrams of the typical ice making process.
Figure 10B:
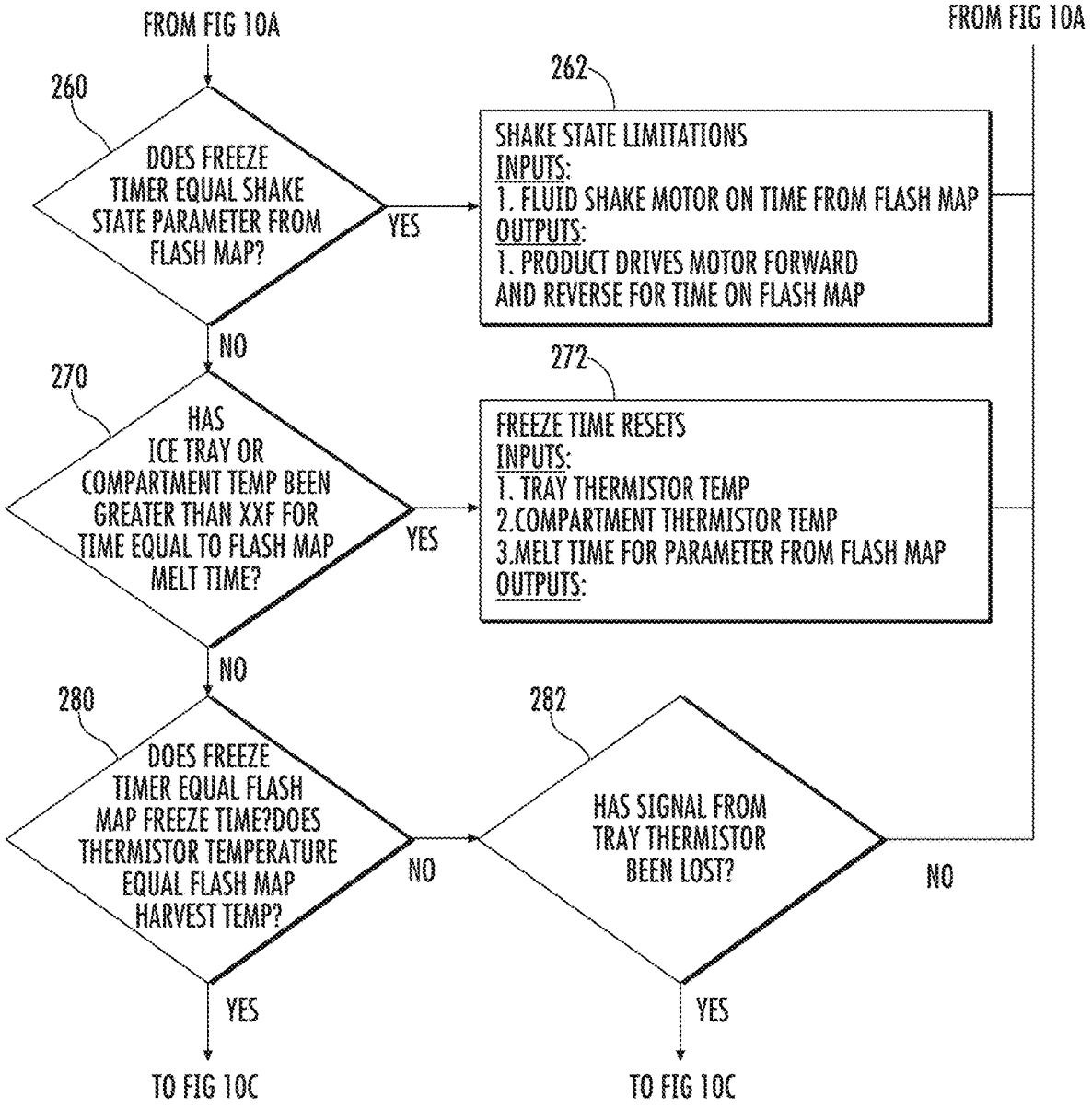
Figure 10C:
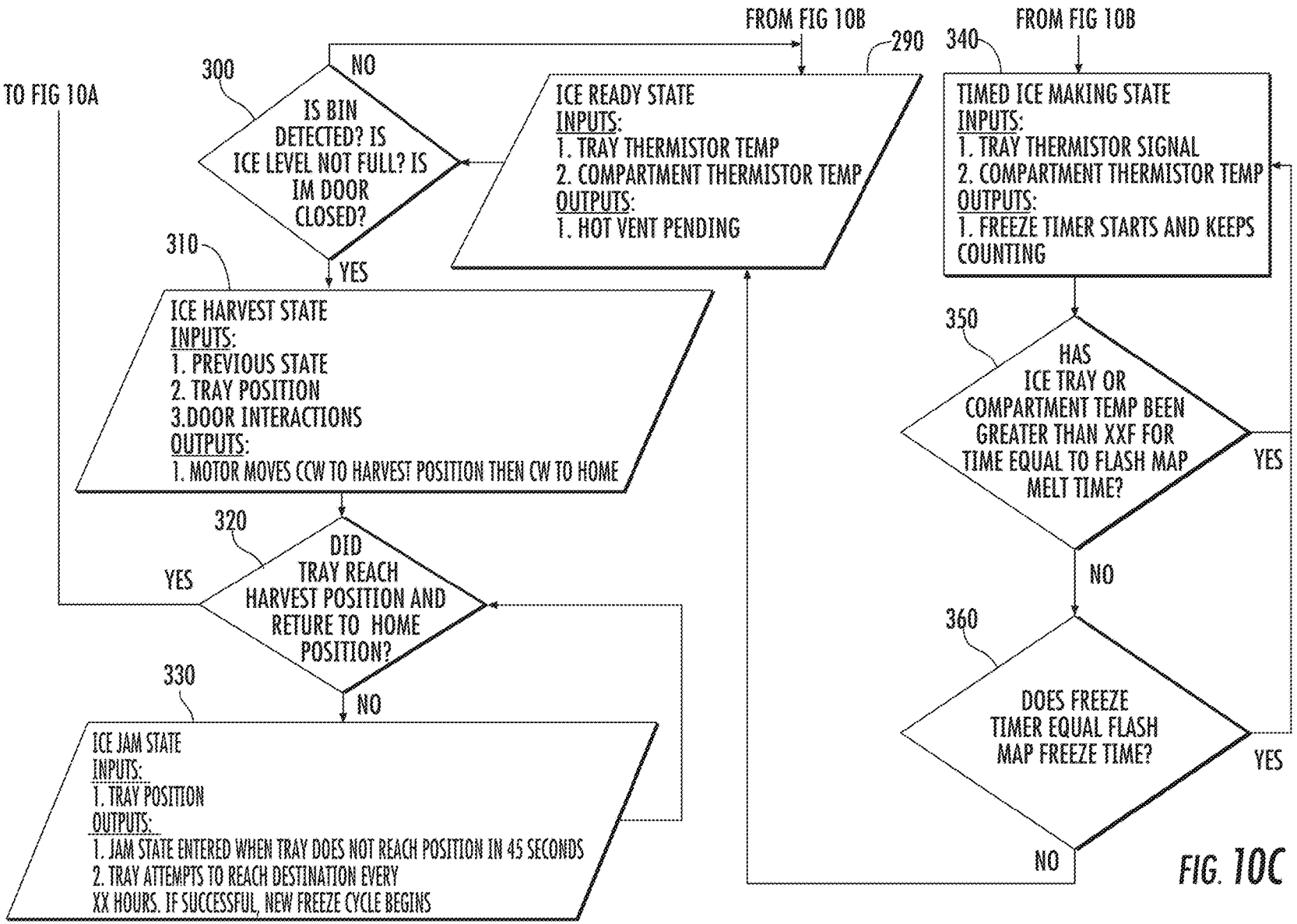

As shown by step 310, when the controller receives a signal that the ice storage bin 54 is in place, it will send a signal to the motor 24 to begin rotating about the axis of rotation X-X, as shown in FIG. 8, such that the ice tray 28 is substantially inverted, as shown in FIGS. 9A and 9B. As the motor 24 begins rotating, the ice tray 28, which is rotationally engaged with the motor 24 at the first end 30, rotates with it. The ice tray 28 typically begins at a substantially horizontal and upright position Z-Z. The motor 24 rotates the entire ice tray 28 to an angle $\alpha$ (See FIG. 8) such that the ice tray 28 is substantially inverted. When the motor 24 and tray reach angle $\alpha$, the second end 32 of the ice tray 28 may be prevented from rotating any further by a bracket stop 100 on the bracket 22 (See FIG. 4A). With the second end 32 held in place by the bracket stop 100, the motor 24 continues to rotate the first end 30 of the ice tray 28 to an angle $\beta$. By continuing to rotate the first end 30, a twist is induced in the ice tray 28. The twist angle $\theta$ is an angle defined as:

$$\theta=\beta-\alpha$$

The twist in the ice tray 28 induces an internal stress between the ice and the ice tray 28, which separates the ice from the ice tray 28. The twist angle $\theta$ may be any angle sufficient to break the ice apart into ice pieces 372 and also break the ice loose from the ice tray 28. As shown in FIGS. 9A and 9B, a unique feature of the ice member and ice tray 28 of the present disclosure is the ability to be rotated substantially upside-down and horizontal when dispensing ice pieces 372. The angle $\alpha$ is preferably greater than 150°, and ideally about 160°, and the angle $\beta$ is preferably greater than 190° and ideally about 200°. The twist angle $\theta$ is preferably greater than 30°, and ideally about 40°.

By rotating the ice tray 28 to a position substantially horizontal with the ice facing downward into the ice storage bin 54 before inducing the twist, the ice may be dropped in a substantially uniform and even configuration into the ice bin 54 as shown in FIG. 9B. In this manner, more complete ice dispensing is achieved. Dropping ice uniformly into the ice bin 54 avoids ice buildup on one side of the ice storage bin 54, which could lead to a situation where a sensor indicates that the ice storage bin 54 is full when only half of the ice storage bin 54 is full, or vice versa, as shown in a prior art example of FIG. 9C. This enables more ice to be disposed and stored within the ice storage bin 54. Additionally, by rotating the ice tray 28 to be substantially horizontal and inverted, the ice maker 20 may harvest the ice pieces 372 without the use of a bumper 102, as shown in the prior art example of FIG. 9C. As is generally known in the art, a bumper 102, or ice guide, aids ice to fall into an ice storage bin 54 or ice bucket when the ice tray 28 is not rotated substantially horizontal, as some of the ice may spill into the fresh food compartment 12.

Referring again to FIGS. 8-9B and 10A-10C, after the rotation is complete, the motor 24 returns to its home position as indicated at lines Z-Z in FIG. 8. If the controller determines that the ice tray 28 reached the harvest position and is back to the home position, the cycle may begin again at step 210. The typical harvest cycle takes from about 100 minutes to about 120 minutes, most typically about, or exactly, 115 minutes to complete. As shown in step 330, if the controller determines that the ice tray 28 did not reach home position, it will re-attempt to move it back to the home position typically every 18-48 hours, and ideally every 24 hours.

If in step 280 the temperature measured by first thermistor 106 does not equal a specified predetermined temperature, the controller may determine if the signal from the first thermistor 106 has been lost. If the signal has not been lost, the process reverts back to step 240 and the harvest process is begun again. If the signal has been lost, the ice maker 20 typically turns to a time-based freezing process, as shown by step 340. As shown in steps 350 and 360, the controller will determine if the temperature of the ice tray 28, or ice compartment temperatures, have been above about 20° F. (−6.67° C.) to about 30° F. (−1.11° C.), typically about 25° F. (−3.89° C.), for 5-15 minutes, more typically about or exactly 10 minutes. If either of these have been met, the process reverts back to step 340 and the freezing process is restarted. Once a predetermined time has been met, the harvest process is begun at step 290.

It is presently believed, through experimentation, that using the disclosed design and process for the ice maker 20 of the present disclosure, surprisingly, is capable of producing more than 3.5 pounds of ice per 24-hour period, more typically above 3.9 pounds (or above about 3.9 pounds) per 24-hour period. This ice production rate is achieved during normal (unaltered) operation and not through activation of a "fast-ice" or a temporary ice making condition. It is also presently believed that using a "fast-ice" mode with the disclosed design and process may produce up to as much as about 4.3 lbs. of ice per 24-hour period. This is a surprising and substantial improvement over other heaterless-tray systems that produce ice at a slower rate. As used in this disclosure, "fast-ice" mode is defined as a temporary mode specified by a user on a user interface 15 (FIG. 1) that will force a greater amount of cold air to the ice maker receiving space 52 and the ice maker 20 in order to speed up the freezing process.

Figure 13:
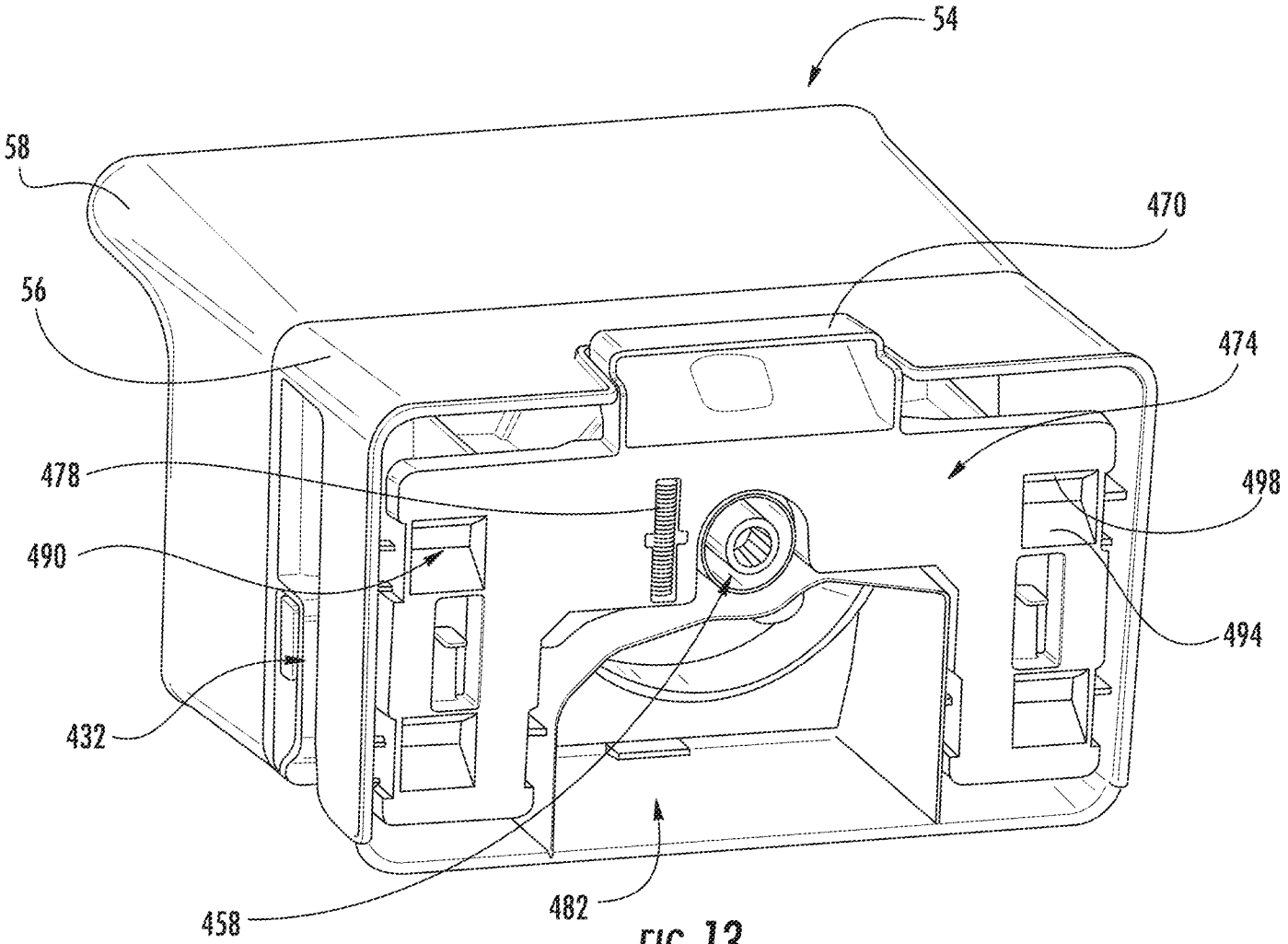
FIG. 13 is a bottom perspective view of an ice bin.
Figure 14:
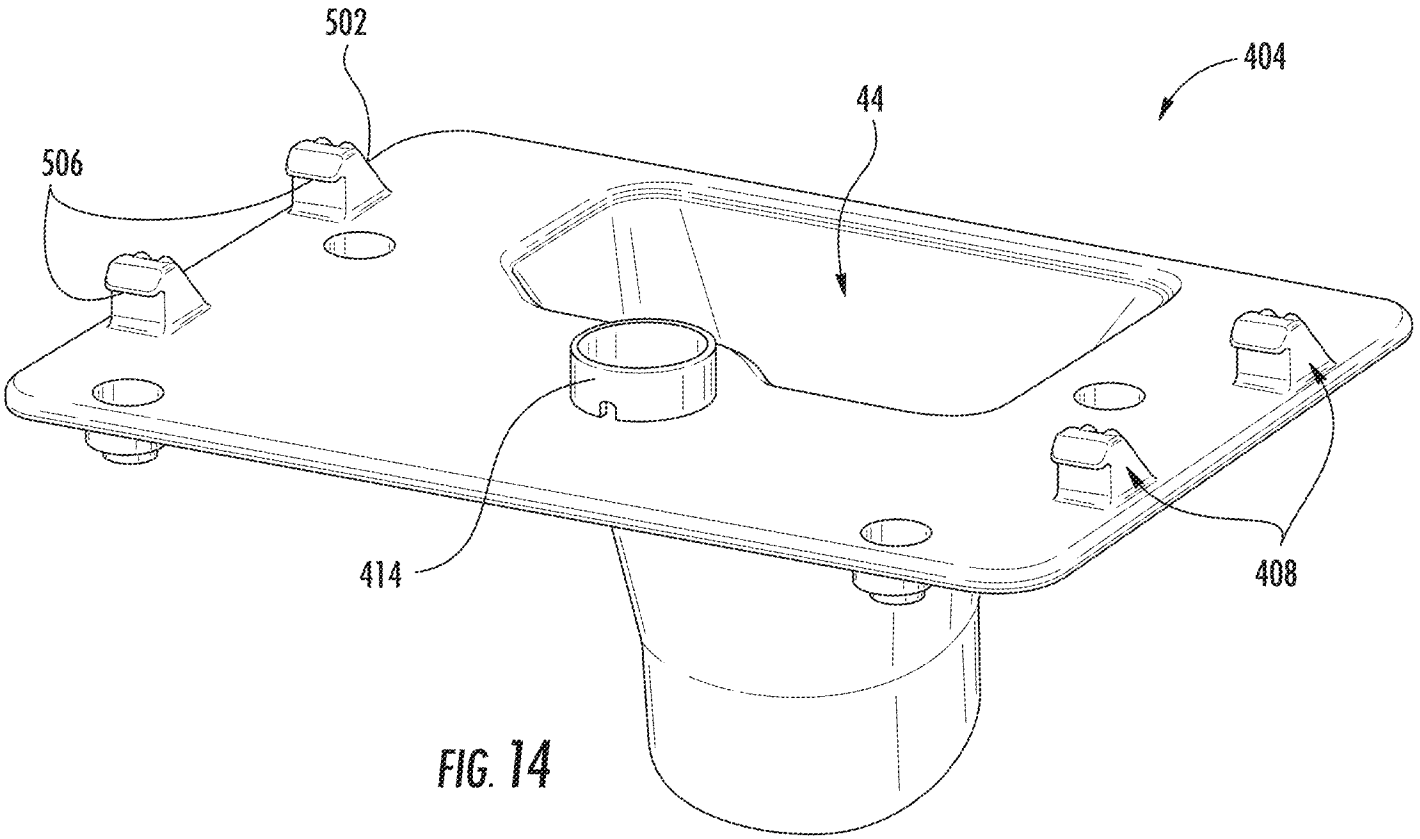
FIG. 14 is a front elevational view of the appliance door of FIG. 13 illustrating the ice storage bin in the sliding state.
Figure 15:
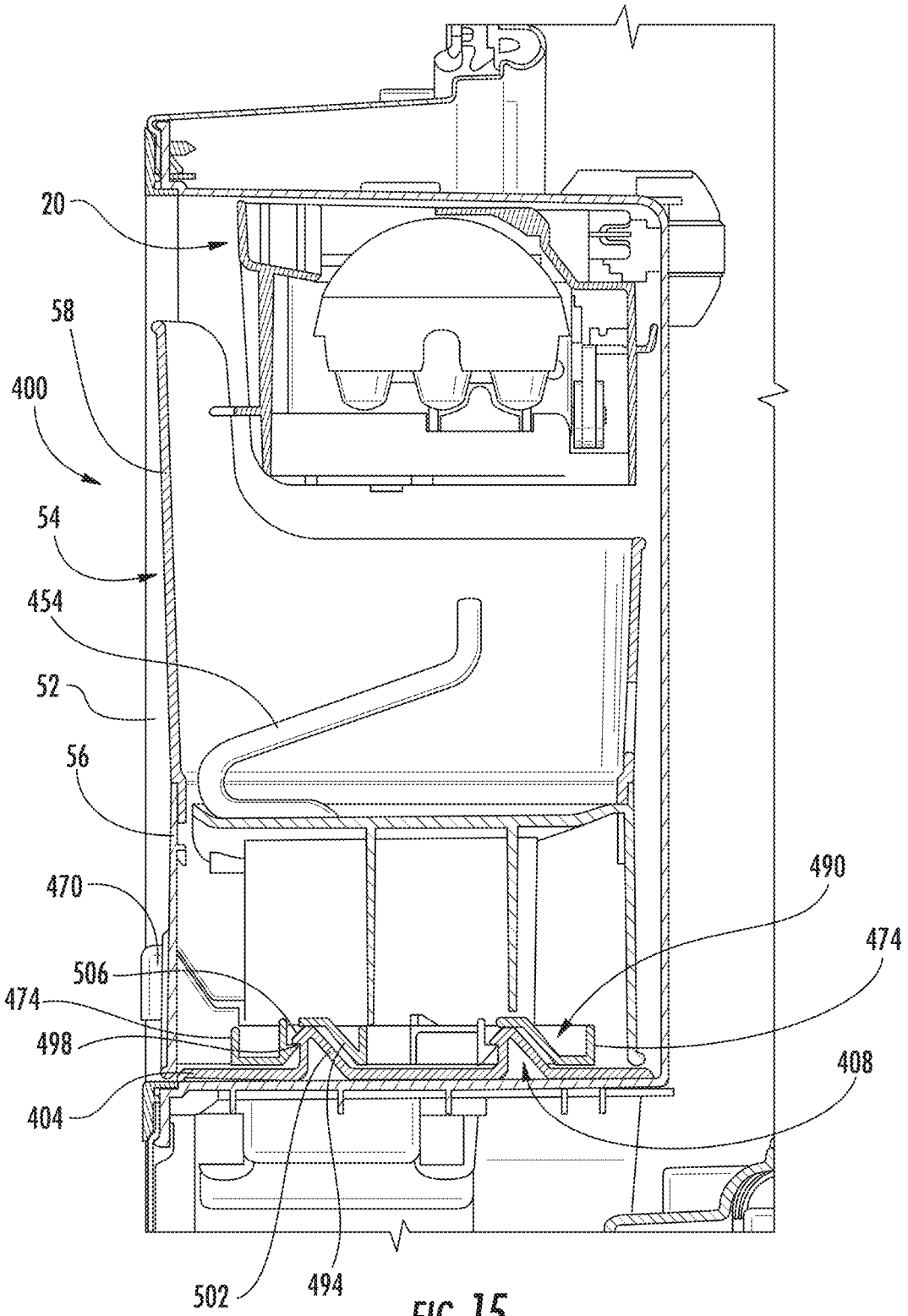
FIG. 15 is a cross-sectional view taken at line XV of FIG. 11 with the ice bin in an engaged state, according to one embodiment.

Referring now to FIGS. 11-15, the ice maker 20 and the ice storage bin 54 cooperate to form an ice maker assembly 400. The ice maker assembly 400 is disposed within the ice maker receiving space 52 defined by the inner liner 50. The ice maker 20 is positioned within a top or upper portion of the ice maker receiving space 52. Positioned at a bottom or lower portion of the ice maker receiving space 52 is a mounting plate 404. The mounting plate 404 includes at least one engagement feature 408 which protrudes in an upward direction into the ice maker receiving space 52. The mounting plate 404 defines, is coupled to or otherwise includes the chute 44 through which ice may fall to the dispensing area 17 (FIG. 1). The mounting plate 404 includes an auger motor shaft 412 disposed through an auger shaft rib 414. The auger motor shaft 412 provides rotational movement to an auger 454 within the ice storage bin 54, as explained in greater detail below. Disposed on opposing side walls of the ice maker receiving space 52 is a rail system 416 on which the ice storage bin 54 may be slidably disposed. In the depicted embodiment, the rail system 416 includes two rails 420, each disposed on opposite sides of, and extending into, the ice maker receiving space 52. Each of the rails 420 defines a lateral sliding surface 424 which is vertically offset from, and substantially parallel with, the mounting plate 404. As will be described in greater detail below, the rail system 416 cooperates with the ice bin base 56 to transition the ice storage bin 54 between a substantially engaged state (inside of the ice maker receiving space 52, as shown in FIG. 15) and a substantially disengaged state (FIG. 11) with substantially no tilting or rotational movement of the ice storage bin 54.

Figure 11:
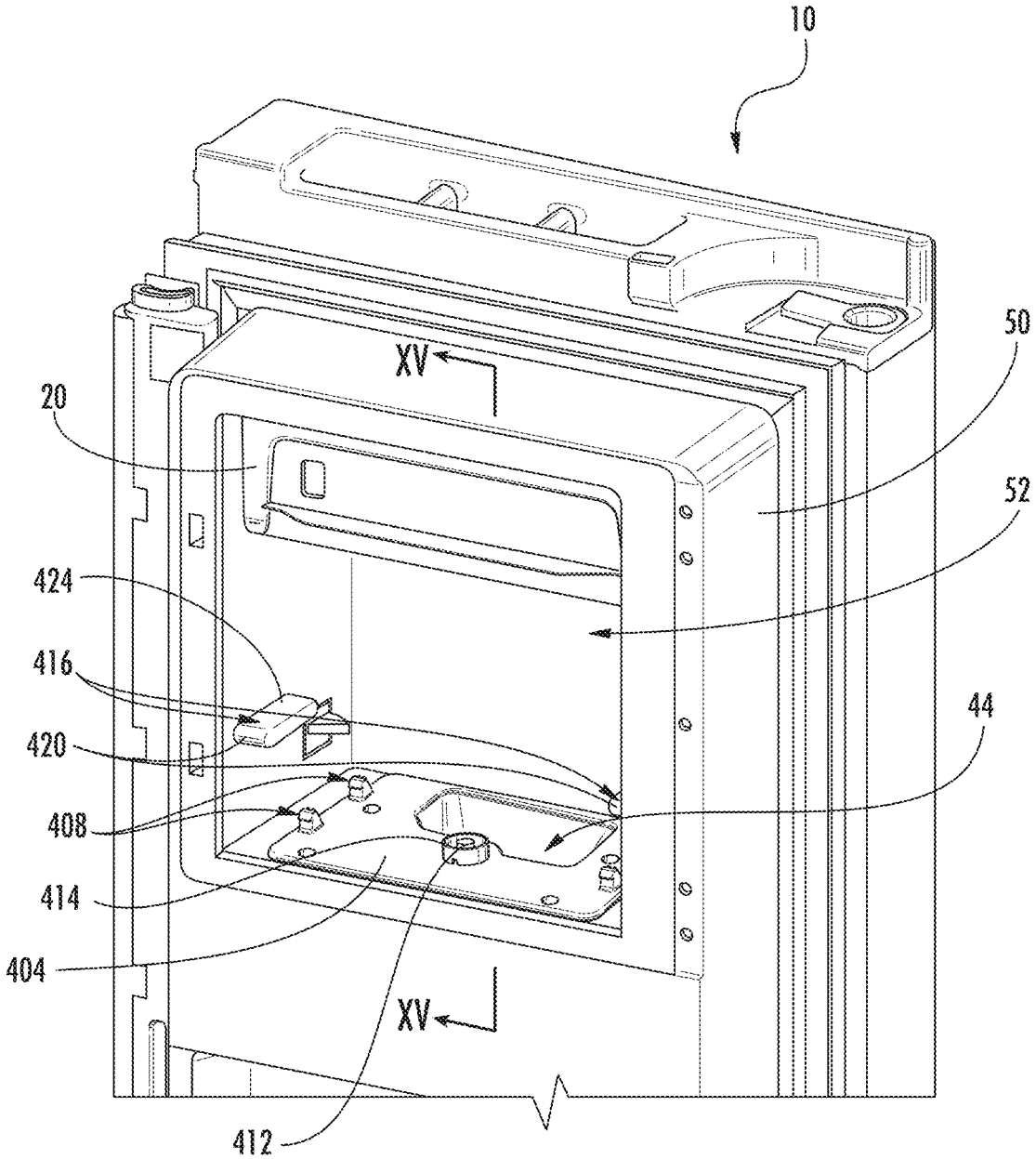
FIG. 11 is a top perspective view of an ice maker without an ice bin.
Figure 12:
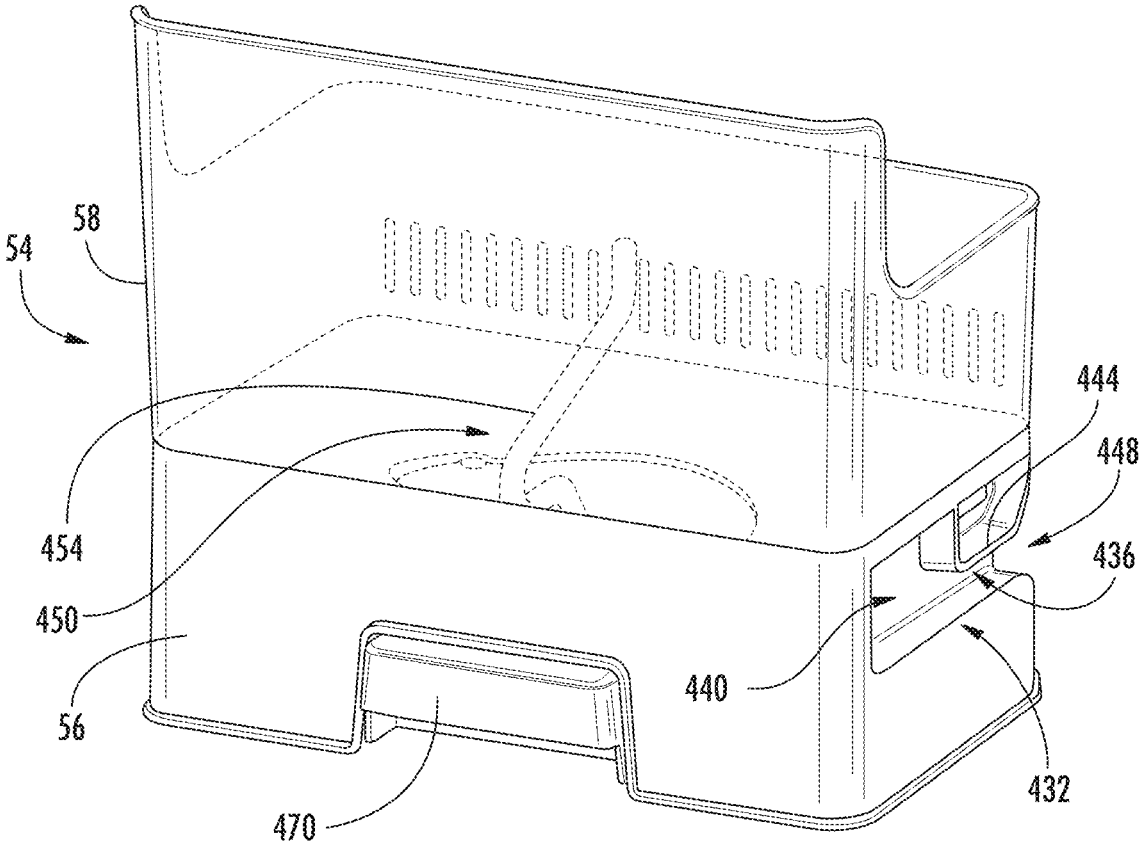
FIG. 12 is a front elevational view of the interior of the refrigerating appliance door illustrating an aspect of the ice storage bin in an engaged state.

Referring now to FIGS. 11 and 12, the ice storage bin 54 includes the ice bin walls 58 positioned on top of the ice bin base 56. In the depicted embodiment, the ice bin base 56 integrally defines a track system 432 which is recessed into the ice bin base 56 and configured to engage the rail system 416. It will be understood that the track system 432 includes two mirrored portions; the portions defined on opposites sides of the ice bin base 56. In the depicted embodiment, the track system 432 includes both an elongate portion 436 and a widened portion 440. The elongate portion 436 of the track system 432 is partially defined by a guide 444 which cooperates with the ice bin base 56 to define an opening 448 to the track system 432 proximate a rear side of the ice storage bin 54. The track system 432 is configured to accept the rails 420 through the opening 448 such that the guide 444 is in contact with the sliding surface 424 of the rails 420. Sliding of the sliding surface 424 along the guide 444 facilitates horizontal motion of the ice storage bin 54 in (toward the engaged state) and out (toward the disengaged state) of the ice maker receiving space 52. Once the ice storage bin 54 has slid in a sufficient distance into the ice maker receiving space 52, the rails 420 enter the widened portion 440 of the track system 432. The widened portion 440 of the track system 432 is widened in the vertical direction relative to the elongate portion 436. The widened portion 440 may have a width in the vertical direction of greater than a width of the rails 420, and a length in the horizontal direction greater than a length of the rails 420. The widened portion 440 is positioned on the opposite side of the elongate portion 436 than the opening 448 toward a front side of the ice storage bin 54. As the ice storage bin 54 is slid into the ice maker receiving space 52, the rails 420 move through the elongate portion 436 and enter the widened portion 440. The vertical widening of the widened portion 440 permits the ice storage bin 54 to move vertically, both in an upward and a downward direction, without any rotation or tilting as the widened portion 440 settles over the rails 420. The ice storage bin 54 may undergo horizontal motion while moving vertically.

Referring now to FIGS. 12 and 13, an auger assembly 450 is disposed through the ice bin base 56 and includes the auger 454 and auger coupling 458. As the ice storage bin 54 moves in the vertical direction when the rails 420 move through the widened portion 440 of the track system 432, the auger coupling 458 is configured to engage or disengage the auger motor shaft 412. The vertical motion of the ice storage bin 54 allows vertical orientation of the auger motor shaft 412 and auger coupling 458 such that the auger 454 may be powered by mechanics located below the ice storage bin 54 and ice maker receiving space 52. Disposed on the front side of the ice storage bin 54 is a handle 470 which is defined by, or otherwise coupled to, a latch 474. The latch 474 is slidably coupled to a lower and/or bottom side or surface of the ice bin base 56. The latch 474 is spring biased toward the rear side of the ice bin base 56 via a spring 478 such that actuation of the handle 470 moves the latch 474 relative to the ice bin base 56. The latch 474 is shaped to extend around the auger coupling 458 such that sliding of the latch 474 does not contact the auger coupling 458. Additionally, the latch 474 is shaped to avoid blocking a bin chute 482 configured to allow ice stored in the ice storage bin 54 to reach the chute 482. The latch 474 defines one or more retention features 490 configured to engage the engagement features 408 as described in greater detail below. Each of the retention features 490 includes a sloped surface 494 and a retention lip 498. Actuation of the latch 474 is configured to release the engagement features 408 (FIG. 11) from the retention features 490 of the latch 474. The latch 474 is depicted as defining four retention features 490, but may define one, two, three or greater than four retention features 490 without departing from the spirit of the disclosure.

Referring now to FIG. 14, the auger shaft rib 414 is depicted as integrally defined by the mounting plate 404 and extending in an upward direction into the ice maker receiving space 52. The auger motor shaft 412 (FIG. 11) is configured to mate with the auger coupling 458 (FIG. 13) of the ice storage bin 54 in a substantially vertical orientation. As explained above, the engagement features 408 are integrally defined by the mounting plate 404 and extend in an upward direction. Each of the engagement features 408 have a general hook shape and define an angled ramp 502 and an engagement lip 506. The engagement features 408 are dimensioned such that the retention features 490 may slide over the engagement features 408 when the ice storage bin 54 is in the engaged state. The angle of the angled ramps 502 of the engagement features 408 may be substantially similar to that of the sloped surfaces 494 of the retention features 490 such that the angled ramps 502 and the sloped surfaces 494 may slidably contact one another. The engagement lips 506 are positioned on the engagement features 408 to face outward of the ice maker receiving space 52.

Referring now to FIGS. 11-15, in assembly, the engagement lips 506 of the engagement features 408 are configured to engage or lock with the retention lips 498 of the retention features 490. Engagement of the engagement lips 506 and the retention lips 498 may aid in securing the ice storage bin 54 within the ice maker receiving space 52 when in the engaged state. To transition the ice storage bin 54 from the engaged state to the disengaged state, a user pulls the handle 470 of the latch 474 in a direction outward from the ice maker receiving space 52. As the latch 474 moves relative to the ice storage bin 54, the retention lips 498 are disengaged from the engagement lips 506 and the sloped surfaces 494 of the retention features 490 contact the angled ramps 502 of the engagement features 408. As the sloped surfaces 494 contact the angled ramps 502, an upward force is generated on the ice storage bin 54 which causes the ice storage bin 54 to move vertically. As such, horizontal motion of the handle 470 results in a vertical motion of the ice storage bin 54. The vertical motion of the ice storage bin 54 moves the widened portion 440 vertically over the rails 420. As the ice storage bin 54 moves vertically, the auger coupling 458 is disconnected from the auger motor shaft 412. Once the sloped surface 494 has slid the length of the angled ramp 502, the elongate portion 436 of the track system 432 is aligned with the rails 420 such that continued pulling of the handle 470 of the latch 474 results in the elongate portion 436 running along the rails 420 until the ice storage bin 54 is in the disengaged state.

Use of the disclosure may offer several advantages. For example, use of this disclosure may allow for a more efficient use of space. Additionally or alternatively, by utilizing the track system 432, the rail system 416 and the disclosed ice storage bin 54, the ice storage bin 54 may not tilt or rotate as it transitions from the engaged state and disengaged state. By not tilting or rotating the ice storage bin 54, a decrease in the chance of contacting and damaging the ice maker 20 may be achieved. Further, the vertical motion of the ice storage bin 54 while transitioning between the engaged and disengaged states allows for vertical orientation of the auger motor shaft 412, auger 454 and auger coupling 458 which may provide increased agitation of ice within the ice storage bin 54.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate the many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within the described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An ice maker assembly comprising:

an ice maker having a mounting plate that includes an engagement feature having an engagement surface;

an ice storage bin configured for insertion into an ice maker receiving space of the ice maker, wherein the ice storage bin comprises:

a retention surface configured to engage with the mounting plate when the ice storage bin is inserted into the ice maker receiving space; and an ice bin base defining a track system configured to move the ice storage bin both vertically and horizontally, wherein the track system includes an elongate portion configured to move the ice storage bin horizontally and a widened portion configured to facilitate vertical movement of the ice storage bin; and a rail system disposed on opposite sides of the ice maker receiving space and configured to engage the track system.

2. The ice maker assembly of claim 1, wherein the track system is recessed into the ice bin base.

3. The ice maker assembly of claim 1, wherein the elongate portion of the track system is substantially parallel with the mounting plate as the ice storage bin is inserted into the ice maker receiving space.

4. The ice maker assembly of claim 1, wherein the rail system protrudes into the ice bin base while the ice storage bin is inserted into the ice maker receiving space.

5. The ice maker assembly of claim 1, further comprising: an auger motor shaft disposed through the mounting plate.

6. The ice maker assembly of claim 5, wherein the vertical movement of the ice storage bin is configured to engage or disengage an auger assembly with the auger motor shaft.

7. The ice maker assembly of claim 5 wherein the auger motor shaft is positioned through an auger shaft rib, the auger shaft rib integrally formed with the mounting plate.

8. The ice maker assembly of claim 1, wherein the ice bin base of the ice storage bin remains substantially parallel with the mounting plate during both the horizontal and vertical movement.

9. The ice maker assembly of claim 1, wherein the rail system defines a lateral sliding surface.

10. The ice maker assembly of claim 9, wherein the lateral sliding surface is vertically offset from and parallel with the mounting plate, and further wherein the lateral sliding surface is configured to facilitate the horizontal movement of the ice storage bin.

11. A refrigerator comprising:

a cabinet including an automatic ice maker assembly having a mounting plate including an angled ramp and an engagement member, the automatic ice maker assembly also having an ice storage bin that includes an ice bin wall positioned on an ice bin base, a sloped surface configured to engage the angled ramp, and a retention member configured to engage with the engagement member;

an ice maker receiving space defined within the cabinet and including a rail system disposed on opposite sides of the ice maker receiving space; and a track system defined in the ice bin base, the track system configured to engage the rail system such that the ice storage bin moves along the rail system, wherein the track system includes a widened portion configured to facilitate vertical movement of the ice storage bin.

12. The refrigerator of claim 11, wherein the automatic ice maker assembly is operably coupled with a motor and a thermistor is disposed proximate the motor.

13. The refrigerator of claim 11, wherein the mounting plate is configured to engage the retention member of the ice storage bin when the ice storage bin is in an engaged state within the ice maker receiving space.

14. An ice maker assembly comprising:

an ice maker;

a mounting plate positioned within an ice maker receiving space, the mounting plate defining a plurality of engagement features extending into the ice maker receiving space; and an ice storage bin removably positioned within the ice maker receiving space, the ice storage bin comprising:

an ice bin base;

an auger assembly disposed through the ice bin base;

an auger motor shaft disposed through the mounting plate;

an ice tray having a first end and a second end;

a motor that rotates the first end and the second end about an axis of rotation and wherein the motor rotates the first end further than the second end; and a track system defined in the ice bin base, the track system engaging a rail system disposed on opposite sides of the ice maker receiving space.

15. The ice maker assembly of claim 14, further comprising:

a bracket stop that stops the second end during rotation of the ice tray while allowing further rotation of the first end.

16. The ice maker assembly of claim 14, wherein the ice storage bin is disposed below the ice tray.

17. The ice maker assembly of claim 14, wherein the motor rotates the ice tray to an inverted position above of the ice storage bin and twists the ice tray to discharge ice within the ice tray.

18. The ice maker assembly of claim 14 wherein the rail system defines a lateral sliding surface, the lateral sliding surface vertically offset from and parallel with the mounting plate, and further wherein the lateral sliding surface is configured to facilitate horizontal movement of the ice storage bin.

19. The ice maker assembly of claim 18,
wherein the track system is configured to engage the rail system such that the ice storage bin can move vertically on the rail system.

* * * * *